US007185976B2

(12) United States Patent
Inoue et al.

(10) Patent No.: US 7,185,976 B2
(45) Date of Patent: Mar. 6, 2007

(54) LIQUID SUPPLY SYSTEM AND APPARATUS INCORPORATING THE SAME

(75) Inventors: Ryoji Inoue, Tokyo (JP); Hiroyuki Ishinaga, Tokyo (JP); Hideki Ogura, Tokyo (JP); Nobuyuki Kuwabara, Tokyo (JP); Tetsuya Ohashi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 393 days.

(21) Appl. No.: 10/949,074

(22) Filed: Sep. 23, 2004

(65) Prior Publication Data

US 2005/0068391 A1 Mar. 31, 2005

(30) Foreign Application Priority Data

Sep. 29, 2003 (JP) ..... 2003-338723

(51) Int. Cl.
*B41J 2/175* (2006.01)

(52) U.S. Cl. ..... 347/86

(58) Field of Classification Search ..... 347/85–87
See application file for complete search history.

(56) References Cited

U.S. PATENT DOCUMENTS

| | | | | |
|---|---|---|---|---|
| 5,963,237 | A | 10/1999 | Ikkatai | |
| 6,022,102 | A | 2/2000 | Ikkatai | |
| 6,276,784 | B1 | 8/2001 | Ikkatai | |
| 6,347,863 | B1 | 2/2002 | Yuen | |
| 6,382,786 | B2 * | 5/2002 | Iwanaga et al. | 347/86 |
| 6,460,984 | B1 | 10/2002 | Matsumoto et al. | |
| 6,520,630 | B1 | 2/2003 | Oda | |
| 2003/0035036 | A1 | 2/2003 | Ogura | |

FOREIGN PATENT DOCUMENTS

| | | |
|---|---|---|
| JP | 05-096744 | 4/1993 |

* cited by examiner

*Primary Examiner*—An H. Do
(74) *Attorney, Agent, or Firm*—Canon U.S.A. Inc. I.P. Div.

(57) ABSTRACT

An ink supply system in which gas is promptly and smoothly discharged without having a complex structure. The ink supply system includes a hermetically-sealed structure communicating with a liquid-using section, a liquid accommodating section having a liquid storage adapted to store liquid, the liquid accomodating section including a negative pressure generation means, and a plurality of communication paths, including first and second communication paths, that facilitates communication between the liquid chamber and the liquid accommodating section. Each of the first and second communication paths includes a liquid chamber side opening extending into the liquid chamber and a liquid accommodating section side opening extending into the liquid accommodating section. The liquid chamber side opening of the first communication path extends substantially further into the liquid chamber than the liquid chamber side opening of the second communication path, and the liquid accommodating section side opening of the second communication path extends substantially further into the liquid accommodating section than the liquid accommodating section side opening of the first communication path.

16 Claims, 16 Drawing Sheets

LIQUID SUPPLY SYSTEM AND APPARATUS INCORPORATING THE SAME

CROSS REFERENCE TO RELATED APPLICATIONS

This application claims priority from Japanese Patent Application No. 2003-338723 filed Sep. 29, 2003, which is hereby incorporated by reference herein.

BACKGROUND OF THE INVENTION

1. Field of the Invention

The present invention relates to a fluid communication structure that unwastefully and stably supplies a liquid such as ink and the like from an ink tank acting as a liquid accommodating section and the like to, for example, a recording head acting as a liquid use section (including a device called a pen) and the like as well as discharges gas existing in the liquid use section into the liquid accommodating section, and relates to a liquid or ink supply system using the fluid communication structure and to an inkjet recording head and an inkjet recording apparatus using the ink supply system.

2. Description of the Related Art

Recently, liquid-using apparatuses, for example, inkjet recording apparatuses, which form an image on a recording medium by applying ink as a liquid onto the recording medium using, for example, an inkjet recording head, are used in a lot of prints including color prints because they can form small dots at a high density with relatively low noise in recording. As a mode of the inkjet recording apparatuses described above, there is an inkjet recording apparatus which includes an inkjet recording head, a carriage, and a transportation means. The ink jet recording apparatus executes recording by ejecting ink in a main scan process of the recording head. In the inkjet recording apparatus, the inkjet recording head receives the ink supplied from an ink tank unseparably or separably attached to the recording head. The carriage has the recording head mounted thereon and causes the recording head to scan the recording medium in a predetermined direction. The transportation means transports (subscans) the recording medium in a direction perpendicular to the predetermined direction with respect to the recording head. Further, there is an inkjet recording apparatus that has a recording head mounted on a carriage in which the recording head is capable of ejecting color inks of yellow, cyan, magenta, and the like. With this arrangement, the inkjet recording apparatus can print not only a monochrome text image but also a full color test image by changing an ejection ratio of the respective inks.

In the inkjet recording apparatuses described above, a problem arises in the proper discharge of gas, such as air and the like, which is trapped or has been trapped in an ink supply path.

The gas, which enters the interior of the supply system, can be roughly classified into four types of gas according to its origins:

1) gas entering from ink injection ports of a print head or generated in an ink ejecting operation;
2) gas separated from the gas dissolved in the ink;
3) gas entering from the outside through a raw material constituting the ink supply path by gas transmission; and
4) gas entering when a cartridge type ink tank is replaced.

Incidentally, a very fine liquid path is formed in the inkjet recording head. Accordingly, the ink, which is supplied from the ink tank, is required to be in a very clean state without foreign substances, such as dusts and the like, trapped therein. That is, when foreign substances such as dusts are trapped in the ink, a problem arises in that ejection ports, which are particularly narrow in the ink flow path of the recording head, or a liquid path, which directly communicates with the ejection ports, become clogged with the foreign substances. Accordingly, it may become impossible to normally execute an ink ejecting operation or to recover the function of the recording head.

To cope with the above problem, a filter can be disposed in an ink flow path between the recording head and an ink supply needle pierced into the ink tank to prevent foreign substances from entering a recording head side.

Recently, to realize high speed recording, the number of ejection ports for ejecting ink has increased and a drive signal applied to a device for generating energy for ejecting ink employs an increasingly higher frequency. As a result, an amount of consumption of ink per unit time has increased.

Since an amount of ink passing through the filter is thereby increased, it is effective to dispose a filter having a large area. As such, the ink supply path is enlarged and a pressure loss is caused by the filter. Accordingly, when bubbles are trapped in the ink supply path, they can build up in a space upstream of the filter in the enlarged portion and cannot be discharged, which inhibits the smooth supply of ink. Further, the gas built up in the supply path can become fine bubbles which can be trapped in the ink introduced into the ejection ports and cause faulty ink ejection and the like.

Accordingly, it is desireable to immediately eliminate air built up in the ink supply path. Several methods to meet the desire can be exemplified.

One method is to execute a cleaning operation as described below.

An inkjet recording head executes printing by ejecting liquid ink from ejection ports disposed in confrontation with a recording medium in the form of, for example, droplets. Accordingly, faulty printing may occur due to an increase in viscosity and solidification of ink because an ink solvent evaporated from the ejection ports, due to deposition of dust on the ejection ports, or due to the clogging of the ejection ports caused by the bubbles trapped in the liquid path within the ejection ports.

To overcome this problem, the inkjet recording apparatus is provided with a cap member and a wiping member. The cap member covers the ejection ports of the recording head when no printing operation is executed. The wiping member cleans the surface of the recording head through which the ejection ports are formed (ejection port forming surface) when necessary. The cap member not only functions as a lid for preventing the ink in the ejection ports from being dried when no printing operation is executed, but also functions to refresh the ejection ports clogged with solidified ink and for overcoming faulty ink ejection caused by an increase in viscosity of the ink in a liquid path and trapped bubbles. This function is executed when the ejection ports are clogged by covering the ejection port forming surface with the cap member and sucking and discharging ink from the ejection ports by applying a negative pressure thereto from a suction pump that communicates with the inside of the cap member.

The forcible ink discharge process for overcoming the faulty ink ejection is a called a cleaning operation. This is executed when printing is resumed after the recording apparatus is out of operation for a long period of time and when a user turns on, for example, a cleaning switch by recognizing that quality of a recorded image is deteriorated, and the like. Further, after ink is forcibly discharged by the cleaning operation, a wiping operation is executed on the ejection port forming surface with the wiping member composed of an elastic plate such as a rubber plate.

In a cleaning operation executed when a flow path and a liquid path of the recording head are initially filled with ink and when an ink tank is replaced, there is executed a trial for discharging built-up bubbles by applying a large negative pressure to the capped ejection port forming surface by driving the suction pump at high speed and obtaining a high flow speed of ink in an ink supply path.

However, an increase in the area of the filter for suppressing a dynamic pressure of the filter increases a sectional area of the flow path. Accordingly, even if the large negative pressure is generated in the flow path by the cleaning operation described above, a high flow speed, at which bubbles can be effectively transferred, cannot be generated, and thus it is very difficult to eliminate remaining bubbles from the ejection ports by the suction pump. That is, the ink passing through the filter must be provided with a predetermined flow speed as a condition in which bubbles are caused to pass through the filter by the ink flow generated by the suction pump. For this purpose, however, a large pressure difference must be generated on both sides of the filter to obtain the predetermined flow speed. To realize the large pressure difference, it is ordinarily contemplated to increase a flow path resistance by reducing the area of the filter or to increase a flow amount of the suction pump. However, when the filter is reduced in size, an ink supply performance to the recording head is deteriorated. Further, when it is intended to eliminate gas by a large amount of flow of ink, a large amount of ink is discharged, thereby ink is wastefully consumed.

Therefore, other methods for eliminating bubbles include: (1) a method of directly discharging bubbles to the outside; and (2) a method of moving bubbles to an ink tank side and reserving them in a portion of the ink tank where they do not inhibit an ink supply. In the former method, a communication port to the outside is disposed in an ink supply path, which is not preferable because of the reasons described below.

That is, some inkjet recording apparatuses have a capillary force generation member such as an absorbent and the like disposed in an ink tank to prevent the unpreferable leakage of ink from ejection ports. Alternatively, they generate a negative pressure in an ink accommodation space of the ink tank by applying an urging force in a direction where the volume of a flexible ink accommodation bag is increased, the urging force being generated by an elastic member such as a spring or the like disposed to the bag. In this case, when a simple communication port is disposed to the ink supply path to eliminate bubbles, the negative pressure is released by the air entering from the communication port. To cope with the problem, a pressure regulation valve or the like must be disposed to the communication port. However, an ink supply system and a recording apparatus using the system are made complex in structure and increased in size. Further, a water repellent membrane or the like, through which gas can pass but a liquid cannot pass, must be provided to prevent the leakage of ink from the communication port for discharging bubble, or a device (composed of a bubble quantity sensor, a communication path opening/closing mechanism, and the like) is necessary to open the communication port and to discharge bubbles only when they build up. However, manufacturing costs are increased, and the structure of the recording apparatus is made complex and the size thereof is increased.

In contrast, it is examined to move bubbles to the ink tank side. At the time, if an amount of ink, which corresponds to the volume of the bubbles moving to the ink tank, can be transferred to the recording head side, a volume inside the ink tank does not change. This is preferable because a generated negative pressure can be kept constant, and a negative pressure, which balances a holding force of a meniscus formed to ejection ports, can be applied to the recording head. Further, when a cartridge type ink tank is employed, the ink tank can be replaced with a new ink tank when an amount of the ink remaining therein decreases. Thus, it can be said that the above arrangement can completely eliminate gas from an ink supply system.

Many consumer inkjet recording apparatuses are arranged such that a cartridge type ink tank, in which black and color inks are accommodated, respectively, is detachably mounted above a recording head or on a carriage, on which the recording head is mounted. That is, many of ink cartridges begin to supply ink into a recording head when, for example, a hollow ink supply needle, which is mounted on a carriage upward, is pierced thereinto. Accordingly, attention must be paid to an inside diameter of the ink supply needle that couples the ink cartridge with the recording head. This is because although a thin supply needle is preferably used to execute a cartridge mounting operation simply without the need for a large force, a decrease in the inside diameter of the needle increases a meniscus force, by which smooth movement of bubbles is made difficult.

Incidentally, several proposals have been made as to a mechanism for moving gas to an ink tank side.

For example, Japanese Patent Laid-Open No. 5-96744 (hereinafter, referred to as "patent document 1") discloses that a recording head side is divided into a first chamber having an atmosphere communication port and a second chamber having a capillary force generation member. The first chamber is coupled with an ink tank through at least two communication paths disposed on the first chamber side. These communication paths include openings having different heights. With this arrangement, air is supplied to the ink tank side through one of the communication paths to the ink tank side. In the above arrangement, a negative pressure is applied to a recording head by a difference of water heads between the first and second chambers or by the capillary force generation member disposed in the second chamber, and thus the atmosphere communication path can be disposed to the first chamber.

However, an object of the arrangement of the patent document 1 is to introduce outside air into the ink tank as ink is supplied therefrom in order to completely use the ink in the ink tank which does not deform. Accordingly, it is not an object of the patent document 1 to discharge bubbles remaining in an ink supply path into the ink tank. That is, the technology disclosed in the patent document 1 cannot be applied to transfer even gas from the ink supply path, in particular, from the second chamber or the recording head side into the ink tank.

Further, as another proposal, Japanese Patent Laid-Open No. 11-309876 (corresponding U.S. Pat. No. 6,460,984) (hereinafter, referred to as "patent document 2") discloses that when a negative pressure generation member accommodating chamber is separable from a liquid accommodation chamber, a gas-introduction-oriented path and a liquid taking-out path are disposed to a communicating section that couples the negative pressure generation member accommodating chamber with the liquid accommodation chamber in order to securely introduce gas into the liquid accommodation chamber. However, the patent document 2 also discloses a capillary force generation member and an atmosphere communication port disposed between an ink tank and a recording head. Accordingly, the patent document 2 discloses an ink supply path opened to the atmosphere in which gas is free to enter into and exit from the ink supply path through an opening acting as the atmosphere communication port similar to the patent document 1. Accordingly, the technology disclosed in the patent document 2 cannot be applied for eliminating the bubbles remaining in the ink supply path.

Further, U.S. Pat. No. 6,347,863 (hereinafter, referred to as "patent document 3") discloses an ink container (50) having a drain conduit (66, 72, 74) and a vent conduit (76, 82, 84) each projecting downward from the ink container (50). In this arrangement, the drain conduit has an upper opening formed to the bottom of an inner wall of the ink container, and the vent conduit has an opening disposed inside of the accommodation space of the ink container. An object of the technology disclosed in the patent document 3 is to arrange a system for refilling ink to a member (14) having a reservoir (16, 18, 20). It is not an object of the patent document 3 to eliminate bubbles remaining in an ink supply path located downstream of the reservoir and in portions in which ink is used. Further, since a lower opening of the drain conduit and a lower opening of the vent conduit have the same height, it is contemplated that when a meniscus is formed in the conduits, a liquid and gas cannot move therein. Further, although the patent document 3 does not disclose an atmosphere communication port, it is contemplated that it is disposed anywhere. This is because if a system composed of the ink container (5) and the member (14) is hermetically sealed, the internal negative pressure of the system increases abruptly as ink is continuously used, and the ink cannot be supplied to the portion in which the ink is used. Accordingly, it is assumed that the atmosphere communication port is disposed to the reservoir (16, 18, 20) in consideration of a foam (90) accommodated in the reservoir (16, 18, 20) and the arrangement and function of the ink container, the drain conduit, and the like. However, the patent document 3 does not have a standpoint for positively eliminating the bubbles remaining in the ink supply path because of the reasons described in the above items 1) to 4) in any case.

Japanese Patent Laid-Open No. 10-29318 (corresponding U.S. Pat. Nos. 5,963,237, 6,022,102 and 6,276,784) (hereinafter, referred as "patent document 4") discloses that an ink replenishment tank can be coupled with a reservoir tank. The reservoir tank includes a negative pressure generation member accommodating chamber and an ink accommodation chamber. The ink replenishment tank replenishes ink to the reservoir tank. In the above arrangement, when the replenishment tank is coupled with a space in the ink accommodation chamber at upper and lower portions of the ink accommodation chamber, ink is introduced from the replenishment tank into the ink accommodation chamber through a lower liquid communication pipe, and air is introduced from the ink accommodation chamber into the replenishment tank through an upper gas communication pipe. However, the arrangement of the patent document 4 is similar to the arrangements of the patent documents 1 and 2 in that a negative pressure generation member and an atmosphere communication port are interposed between the ink accommodation chamber and a recording head. Accordingly, the technology disclosed in the patent document 4 cannot be applied to an object of eliminating bubbles remaining in the ink supply path.

Further, Japanese Patent Laid-Open No. 2001-187459 (corresponding U.S. Pat. No. 6,520,630) (hereinafter, referred to as "patent document 5") discloses that a subtank 1022 is mounted above a main tank 1020 to replenish ink into the main tank 1020 that communicates with a recording head 1018 as shown in FIG. 16. The gas in the main tank is introduced into the subtank and the ink in the subtank is supplied into the main tank as a carriage is accelerated and decelerated. In the patent document 5, the main tank communicating with the subtank accommodates ink in a free state. However, since the main tank includes means for introducing outside air thereinto, the arrangement of the patent document 5 is not essentially different from those of the patent documents 1, 2, and 4. That is, the patent document 5 does not have a standpoint for positively eliminating the bubbles remaining in an ink supply path because of the reasons shown in the items 1) to 4).

An arrangement common to the patent documents 1, 2, 4, and 5 resides in that the separable liquid accommodation unit (ink tank) communicates with the recording head through a plurality of the communication paths and that the atmosphere introduction means is provided downstream of the communication paths (on the recording head side). A problem arising in the above arrangement will be explained with reference to the patent document 5.

FIG. 16 is a conceptual view explaining the invention disclosed in the patent document 5. In a state shown in FIG. 16, a balance of forces acting on a meniscus formed by a pipe 1056A will be examined assuming that movement of air stops (movement of gas to a subink chamber 1081 of the subtank 1022 through the pipe 1056A). First, a downward-acting force includes a pressure HA and a meniscus force, the pressure HA being generated by a difference of water heads between the liquid surface of the ink in the subink chamber 1081 and the position of a meniscus formed in an opening the pipe 1056A. Further, an upward-acting force includes a pressure P generated by the air reserved in an ink bag 1100 disposed in the main tank 1020. The movement of air is stopped because all the forces are balanced. In this case, the air pressure P balances a sum of the pressure, which is generated by a difference of water heads between the liquid surface of the ink in the subink chamber 1081 and the liquid surface position of the ink in the ink bag 1100, and the pressure generated by the meniscus (P=HA+MA). Further, since the ink in the subink chamber 1081 communicates with the ink in the ink bag 1100 through a pipe 1056B, a difference between a downward acting ink pressure that acts on the meniscus formed in the pipe 1056A and the gas pressure in the ink bag 1100 is equal to a pressure HB−HA generated by a difference of water heads between the meniscus position in the pipe 1056A and the liquid surface in the ink bag 1100. As a result, the balanced state is achieved by that a pressure HB−HA generated by the difference of the water heads balances the meniscus pressure MA.

When the liquid level in the ink bag 1100 falls because ink is further consumed from the above state and bubbles are introduced from a bubble generator 1104, and the like, the pressure HB−HA, which is generated by the difference of the water heads between the meniscus position in the pipe 1056A and the liquid level in the ink bag 1100, increases. Then, when the pressure HB−HA finally exceeds the meniscus pressure, air is introduced into the subink chamber 1081, thereby the ink in the subink chamber 1081 is supplied into the ink bag 1100.

However, when ink is ejected by the recording head 1018, since an ink flow is generated in an overall supply system, a pressure loss is generated between the subink chamber 1081 and the ink bag 1100 based on an amount of ink flowing in the pipe 1056B. Accordingly, the pressure loss must be further taken into consideration, in addition to the relation between the meniscus pressure MA described above and the pressure HB−HA generated by the difference of the water heads between the meniscus position and the liquid surface in the ink bag 1100. As a result, air moves when the pressure generated by the above difference of the water heads exceeds the meniscus pressure to which the pressure loss is added. That is, a gas/liquid exchange does not occur unless the liquid surface falls by the pressure loss in the pipe 1056B according to the amount of flow of the ink in an ink ejection state, i.e. in a dynamic state as compared with the air movement stop state. When the liquid surface in which the gas/liquid exchange is to be started becomes lower than the opening of the pipe 1056B, the gas/liquid exchange does not occur, and the ink in the main tank 1020 is completely consumed without using the ink in the subtank 1022.

Accordingly, when the pipe is made thin to simply and easily mount the ink tank as described above, the pressure loss is increased thereby, and thus it must be taken into consideration that the position of the liquid surface, at which the gas/liquid exchange starts in the main tank, falls in correspondence to the increase of the pressure loss. That is, the main tank cannot help being increased in size, by which the recording apparatus is increased in size in its entirety.

Further, it is another problem of the arrangement shown in FIG. 16 that the bubble generator 1104 is disposed under the main tank. That is, there is a possibility that bubbles introduced from the bubble generator 1104 are carried by the flow of ink traveling to the recording head 1018 and pulled into a flow path 1041 that communicates with the recording head 1018 as an ink ejecting operation is executed regardless that it is very preferable to minimize the bubbles that are transferred to ink ejection ports. To prevent the bubbles from being pulled into the flow path 1041, it is necessary to employ a countermeasure for restricting the flow of the ink resulting from the ink ejecting operation and for disposing the bubble generator 1104 at a position apart from a filter 1039, which further increases the size of the main tank 1020.

These disadvantages also occur in the arrangements of the patent document 1, 2, 4 in which the atmosphere introduction means is disposed at a position nearer to the recording head than the communication path.

As described above, the patent documents 1 to 5 disclose to introduce gas into the ink tank located at an uppermost stream position. However, these documents do not satisfy an object of smoothly transferring the gas, which enters the ink supply path having the hermetically-sealed structure in use because of the reasons described in the above items 1) to 4) and builds up therein, into the ink tank and reserving it therein. Further, when an amount of flowing ink increases to execute printing at high speed, an ink supply may not follow the increasing amount of the flowing ink and may be interrupted or bubbles may be trapped in the recording head. To overcome these drawbacks, the recording head cannot be help being increased in size.

SUMMARY OF THE INVENTION

The present invention is directed to a liquid supply system capable of promptly and smoothly eliminating gas, which inhibits a liquid use operation and a liquid supply operation, from a liquid use section without making the structure of the liquid supply system complex.

The present invention is also directed to an inkjet recording apparatus that can smoothly and promptly transfer gas remaining in a hermetically-sealed ink supply path into an ink tank as well as can overcome problems resulting from built-up bubbles, that is, can prevent faulty recording due to a faulty ink supply and to ejection ports clogged with trapped bubbles even when the recording apparatus is actually used.

In one aspect, a liquid supply system of the present invention includes a liquid accommodating section having a liquid storage adapted to store liquid, the liquid accomodating section including means for generating a negative pressure with respect to an atmospheric pressure within the liquid storage; a liquid-using section; a liquid chamber in communication with the liquid-using section; a plurality of communication paths, including first and second communication paths, that facilitates communication between the liquid chamber and the liquid accommodating section; the liquid chamber includes a substantially hermetically sealed space except where the space communicates with the plurality of communication paths and with the liquid-using section; and each of the first and second communication paths includes a liquid chamber side opening extending into the liquid chamber and a liquid accommodating section side opening extending into the liquid accommodating section, wherein the liquid chamber side opening of the first communication path extends substantially further into the liquid chamber than the liquid chamber side opening of the second communication path, and the liquid accommodating section side opening of the second communication path extends substantially further into the liquid accommodating section than the liquid accommodating section side opening of the first communication path.

In another aspect, a fluid communication structure of the present invention that facilitates communication between a liquid accommodating section accommodating a liquid and a liquid use section using the liquid includes a liquid chamber that communicates with the liquid use section, and a plurality of communication paths that facilitates communication between the liquid chamber and the liquid accommodating section. The liquid chamber forms a substantially hermetically-sealed space except where the space communicates with the plurality of communication paths and with the liquid use section. The plurality of communication paths includes at least first and second communication paths each having a liquid chamber side opening extending into the liquid chamber and a liquid accommodating section side opening extending into the liquid accommodating section, wherein the liquid chamber side opening of the first communication path extends substantially further into the liquid chamber than the liquid chamber side opening of the second communication path, and the liquid accommodating section side opening of the second communication path extends substantially further into the liquid accommodating section than the liquid accommodating section side opening of the first communication path. Gas existing in the hermetically sealed space can be transferred to the liquid accommodating section through the second communication path.

In yet another aspect, an ink supply system of the present invention includes an ink tank that having an ink storage adapted to store ink, the ink tank including means for generating a negative pressure with respect to an atmospheric pressure within the ink storage; a recording head that ejects ink, a liquid chamber that communicates with the recording head; and a plurality of communication paths, including first and second communication paths, that facilitates communication between the liquid chamber and the ink tank. The liquid chamber includes a substantially hermetically sealed space except where the space communicates with the plurality of communication paths and with the recording head. Each of the first and second plurality of communication paths includes a liquid chamber side opening extending into the liquid chamber and an ink tank side opening extending into the ink tank, wherein the liquid chamber side opening of the first communication path extends substantially further into the liquid chamber than the liquid chamber side opening of the second communication path, and the ink tank side opening of the second communication path extends substantially further into the ink tank than the ink tank side opening of the first communication path.

In yet still another aspect, an inkjet recording head of the present invention for executing recording by ejecting ink includes the fluid communication structure arranged integrally therewith.

In yet still a further aspect, an inkjet recording apparatus incorporating the ink supply system, wherein the liquid chamber is located substantially above the recording head and the ink tank is located substantially above the liquid chamber with respect to a vertical direction.

According to the present invention, the gas, that inhibits the liquid use operation and the liquid supply operation, can be promptly and smoothly discharged from the liquid use section to the liquid accommodating section without making the structure complex by the provision of the liquid use section using a liquid, the liquid chamber communicating with the liquid use section, the liquid accommodating section accommodating the liquid, the plurality of communication paths communicating the liquid chamber with the liquid accommodating section, and the negative pressure generation means disposed in the liquid accommodating section for generating a meniscus pressure with reference to an atmospheric pressure.

In particular, even if bubbles and a liquid are intermittently connected to each other and multiple meniscuses are formed when the ink tank is mounted, since one of the communication paths causes the liquid accommodating section, in which a negative pressure is generated, to communicate with the liquid chamber first, a fluid moves through the communication path. As a result, the multi-meniscus state can be eliminated and further gas can be promptly and smoothly discharged.

Further, when the present invention is applied to the inkjet recording apparatus, the gas remaining in the hermetically-sealed ink supply path can be smoothly and promptly transferred into the ink tank as well as problems resulting from built-up bubbles can be solved, that is, faulty recording due to a faulty ink supply and to ejection ports clogged with trapped bubbles can be prevented even when the recording apparatus is actually used.

DESCRIPTION OF THE EMBODIMENTS

Embodiments, in which the present invention is applied to an inkjet recording apparatus, will be explained with reference to the drawings.

Here, the term "recording" used for the specification hereof means not only the formation of meaningful information, such as characters, graphics, but also, it is meant to include, in a broad sense, images, designs, patterns, or the like formed on a printing medium, as well as to include processing of the recording medium, irrespective of being meaningful or meaningless, or being apparent to be visually recognizable by eyesight.

Also, the term "printing medium" includes not only paper sheets typically used for a printing apparatus, but also includes cloth, plastic film, metallic plate, glass, ceramic, wood, leather, or the like which is capable of receiving ink. The printing medium may be called a "paper sheet" or simply a "sheet".

Note that the following embodiments will be explained using ink as an example of a liquid used in a liquid supply system of the present invention. It is needless to say, however, that a liquid applicable to the embodiments is not limited to ink and a liquid for treating a recording medium, and the like are included in, for example, a field of inkjet recording.

(First Embodiment)

Overall Arrangement of Ink Supply System

Figure 1:
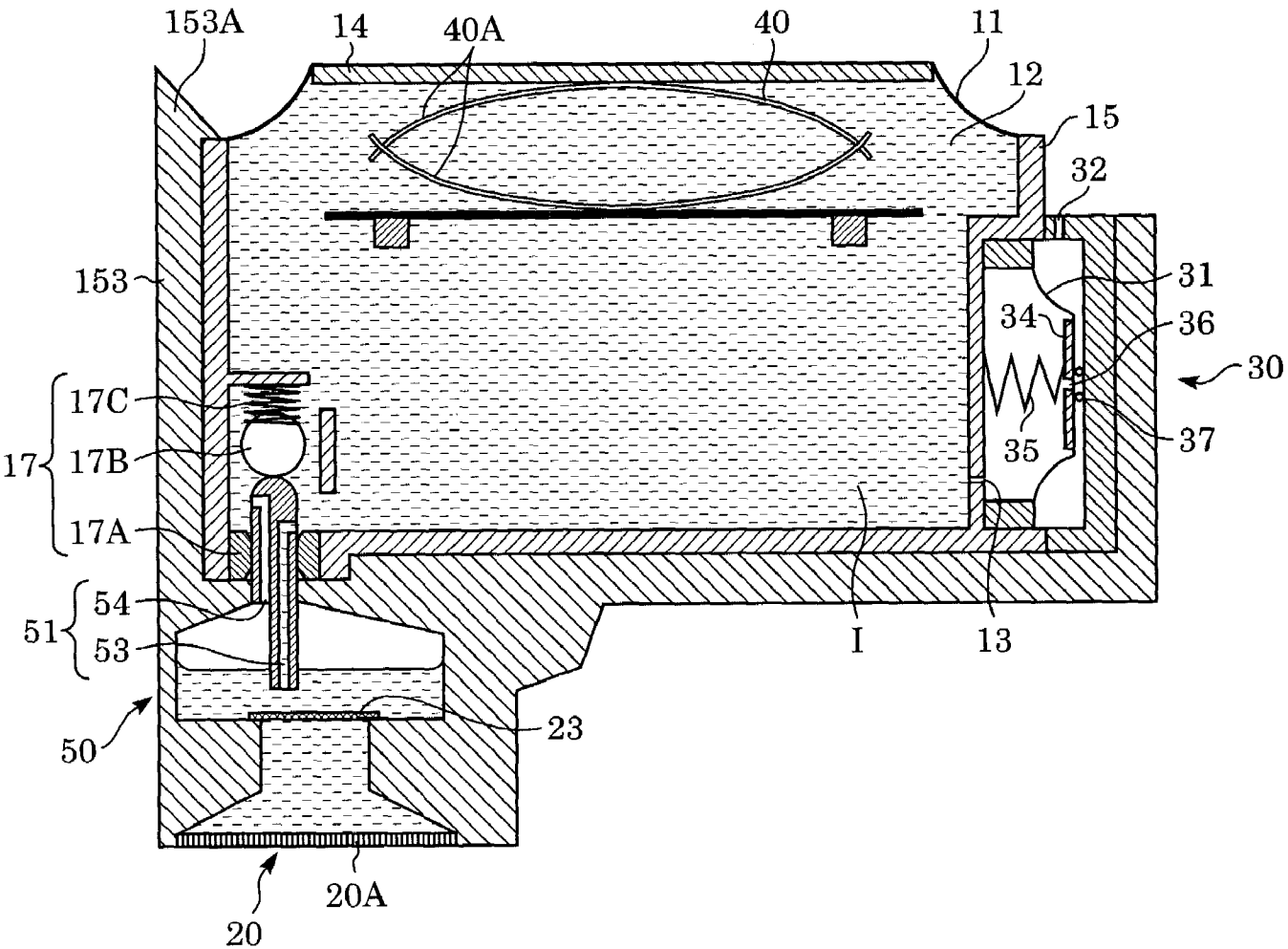
FIG. 1 is a schematic sectional view of a liquid supply system according to a first embodiment of the present invention.

FIG. 1 is a schematic sectional view of a liquid (ink) supply system according to a first embodiment of the present invention.

The ink supply system shown in FIG. 1 is generally composed of an ink tank 10 as a liquid accommodation vessel, an inkjet recording head (hereinafter, simply referred to as "recording head") 20, and a liquid chamber 50 that forms an ink supply path that communicates the ink tank 10 with the inkjet recording head 20. The liquid chamber 50 may be combined with the inkjet recording head 20 so as to be separable or inseparable therefrom. In the illustrated example, the recording apparatus is arranged as a serial scan type recording apparatus, in which the liquid chamber 50 is disposed to a carriage 153 on which the inkjet recording head 20 is mounted. The ink tank 10 can be mounted on and dismounted from the liquid chamber 50 from above. When the ink tank 10 is mounted, an ink supply path is formed from the ink tank 10 to the inkjet recording head 20. The liquid chamber 50 substantially forms a hermetically-sealed space except the connecting sections to the ink tank 10 and the recording head 20. The liquid chamber is not provided with an atmosphere introduction means.

The ink tank 10 is generally composed of two chambers, i.e. an ink accommodation chamber 12, in which an ink accommodation space is partitioned, and a valve chamber 30, and the interiors of both the chambers communicate with each other through a communication path 13. Ink I, which is to be ejected from the recording head 20, is accommodated in the ink accommodation chamber 12 and supplied to the recording head 20 during an ejecting operation. Further, a seal member 17 is accommodated in the ink accommodation chamber 12 at a portion thereof where a connecting section 51 of the liquid chamber 50, which will be described later, is received. In this embodiment, the seal member 17 is composed of a seal member 17A, a ball-shaped valve 17B, and a spring 17C. The seal member 17A has an opening formed thereto, into which the connecting section 51 is pierced, and an elastic member, such as rubber and the like, disposed at least around the opening. The valve 17B can close the opening, and the spring 17C urges the valve 17B toward the closing position of the seal member 17A. Note that the interior of the ink tank 10 is kept in a negative pressure state by the action of a spring 40 to be described later even if the ink tank 10 is not mounted. Accordingly, it is preferable for the valve 17B to hermetically seal the opening securely by appropriately determining the strength of the spring 17C to prevent the leakage of the ink I from the opening of the seal member 17 even if the ink tank is not mounted.

Note that the seal member 17 may be composed of a member such as rubber and the like to which a slit or the like is previously formed at a piercing position so that the connecting section 51 can be easily pierced therethrough. When the connecting section 51 is not pierced, the leakage of the ink may be prevented by closing the slit by the elastic force of the member.

A deformable flexible membrane (sheet member) 11 is disposed in a portion of the ink accommodation chamber 12, and a space in which the ink is accommodated is partitioned between the portion and an inflexible exterior 15. A space outside of the ink accommodation space when viewed from the sheet member 11, that is, a space upwardly of the sheet member 11 in the figure is opened to the atmosphere so that the space has pressure equal to atmospheric pressure. Further, a substantially hermetically sealed space is formed in the interior of the ink accommodation space except the portion thereof for accepting the connecting section 51 of the liquid chamber 50 located below the ink accommodation chamber 12 and the communication path 13 to the valve chamber 30.

The shape of the sheet member 11 of the embodiment is regulated by a pressure plate 14 as a flat support member at a central portion thereof, and the peripheral edge of the sheet member 11 is deformable. The central portion of the sheet member 11 is formed in a convex shape and the side thereof is formed in an approximately trapezoidal shape. As described later, the sheet member 11 deforms according to a change of an amount of the ink and to a pressure fluctuation in the ink accommodation space. At the time, the peripheral portion of the sheet member 11 extends and contract in a good balance so that the sheet member 11 moves in parallel in an up/down direction in the figure while keeping the central portion thereof in an approximately horizontal attitude. Since the sheet member 11 smoothly deforms (moves) as described above, no impact is caused by the deformation thereof, and thus no abnormal pressure fluctuation is caused by the impact in the ink accommodation space.

The spring member 40 is disposed in the ink accommodation space. The spring member 40 generates a negative pressure within a range in which the recording head can execute an ink ejecting operation in balance with the holding force of a meniscus formed to an ink ejecting section 20A of the inkjet recording head 20 by applying a pressing force for urging the sheet member 11 upward in the figure through the pressure plate 14. In addition to the above mentioned, when the volume of the air in the ink accommodation chamber fluctuates due to an environmental change (peripheral temperature and pressure), the fluctuation is absorbed by the displacement of the spring and the sheet so that the negative pressure in the chamber does not greatly fluctuate. Note that although FIG. 1 shows a state that the ink accommodation space is approximately completely filled with the ink, it is assumed that the spring member 40 applies the pressing force even in this state and an appropriate negative pressure is generated in the ink accommodation space.

In the illustrated example, the spring member 40 is composed of a pair of sheet spring members 40A each having an approximately U-shaped cross section and combined together with the U-shaped open ends thereof confronting with each other as the spring disposed in the patent document 6 proposed by the applicant. As a mode of the combination, concave portions and convex portions are formed to both the ends of the respective sheet spring members 40A, and the concave portions are engaged with the convex portions. Note that the spring member 40 is not limited to the sheet spring as described above, and other springs, for example, a coil spring, a conical helix spring, and the like may be used.

A one-way valve is arranged in the valve chamber 30 to introduce gas (air) from the outside when the negative pressure in the ink tank 10 exceeds a predetermined value as well as to prevent the leakage of ink from the ink tank 10. The one-way valve has a pressure plate 34, a seal member 37, and a sheet member 31. The pressure plate 34 has a communication port 36 and acts as a valve closing member. The seal member 37 is fixed at a position confronting the communication port 36 formed through an inside wall of a valve chamber cabinet and can hermetically seal the communication port 36. The sheet member 31, through which the communication port 36 passes, is joined to the pressure plate 34. A substantially hermetically sealed space is maintained also in the valve chamber 30 except the communication path 13 to the ink tank 10 and the communication port 36 communicating with the atmosphere. The space in the valve chamber cabinet located rightward of the sheet member 31 in the figure is opened to the atmosphere through an atmosphere communication port 32, and thus the pressure in the space is made equal to atmospheric pressure.

The sheet member 31 can be deformed around the peripheral edge thereof except the central portion thereof joined to the pressure plate 34, the central portion being formed in a convex shape and the side thereof being formed in an approximately trapezoidal shape. With the above arrangement, the pressure plate 34 acting as the valve closing member can smoothly move right and left in the figure.

A spring member 35 is disposed in the valve chamber 30, the spring member 35 acting as a valve regulation member for regulating a valve opening operation. In the illustrated example, the spring member 35 is formed in a coil spring shape and slightly compressed so that the pressure plate 34 is pressed rightward in the figure by the reaction force of the compressed spring member 35. The spring member 35 is provided with a function as a valve by causing the seal member 37 to come into intimate contact with and to separate from the communication port 36 through the expansion and contraction thereof. Further, the spring member 35 is arranged as the one-way valve mechanism for permitting gas to be introduced only into the valve chamber 30 from the atmosphere communication port 32 through the communication port 36. It is needless to say that the spring member 35 is not limited to the illustrated conical helix spring and other types of springs such as a coil spring and the like can be employed.

Any seal members may be employed as the seal member 37 as long as they can hermetically seal the communication port 36 securely. That is, any seal members can be employed as long as they can secure a hermetically sealed state, and there are exemplified a seal member at least a portion of which in contact with the communication port 36 keeps flatness with respect to an open surface, a seal member having a rib which can be in intimate contact with the periphery of the communication port 36, a seal member formed in such a shape that the extreme end thereof pierces into the communication port 36 and can close it, and the like. Further, a material of the seal member is not particularly limited. However, since the intimate contact is achieved by the expansion force of the spring member 35, it is more preferable to form the seal member of an material that can easily follow the sheet member 31 and the pressure plate 34 which are moved by the action of the expansion force, that is, of an elastic member such as rubber having an expanding/contacting property.

In the arrangement of the ink tank 10 described above, ink is being consumed from an initial state that the ink tank 10 is filled with a sufficient amount of ink, and the negative pressure in the ink accommodation chamber 12 balances a force applied by the valve regulation member in the valve chamber 30, and the like. From this state, as the ink is further consumed continuously, the negative pressure is further increased. The respective components of the ink tank 10 are arranged such that the communication port 36 is opened at the moment the negative pressure is further increased, thereby a large amount of outside air is introduced and taken into the ink accommodation space. The volume in the ink tank 10 can be increased by the introduction of the outside air because the sheet member 11 and the pressure plate 14 can be deformed upward in the figure. Since the negative pressure is decreased at the same time, the communication port 36 is closed.

Further, even if the circumferential environment of the ink tank changes, for example, even if the temperature of the ink tank increases or the pressure therein decreases, the air introduced into the ink accommodation space is allowed to expand within a volume between the position at which the sheet member 11 and the pressure plate 14 are fully displaced and the initial position thereof. In other words, a space corresponding to the above volume functions as a buffer region, thereby an increase in pressure generated by the change of the circumferential environment can be eased, thereby the leakage of ink from ejection ports can be effectively prevented.

Further, no outside air is introduced until the inside volume of the ink accommodation space is reduced as a liquid is consumed from the initially filled state and the buffer region is secured. Accordingly, even if an abrupt change of the circumferential environment, vibration, dropping, and the like occur prior to the introduction of outside air, the leakage of ink is unlikely. Further, since the buffer region is not previously secured from a time ink is not used, the ink accommodation vessel has a high volume efficiency and can be arranged compactly.

In the illustrated example, the recording head 20 is coupled with the ink tank 10 by piercing the connecting section 51 of the liquid chamber 50 arranged integrally with the recording head into the ink tank 10. That is, in the example, the liquid chamber 50 having the connecting section 51 constitutes a fluid communication structure. With this arrangement, both the recording head 20 and the ink tank 10 are coupled with each other to establish a liquid flow therebetween, thereby ink can be supplied to the recording head 20. The exterior 15 of the ink tank 10 is partly engaged with a latch 153A disposed to the carriage 153 so that the mounting state of the ink tank 10 can be maintained.

The ink supply path in the liquid chamber 50 has a portion whose cross section gradually increases from the connecting portion to the ink tank 10 (upstream side) and a portion whose cross section gradually decreases toward the recording head 20 (downstream). A filter 23 is disposed to a portion where the liquid chamber 50 is connected to the recording head 20 so that impurities trapped in ink to be supplied are prevented from flowing into the recording head 20. A gas/liquid interface formed in the liquid chamber 50 by gas staying therein is larger than the lateral sectional areas of flow paths 53 and 54. With this arrangement, since the water head of the ink in the ink tank 10 is applied to the ink in the liquid chamber 50 through the flow path 53, the pressure of the gas existing in the liquid chamber 50 is further increased, which permits gas to be easily exhausted from the air flow path 54 toward the ink tank 10. This is more effective because bubbles are liable to gather in the vicinity of the position of the head side opening of the air flow path 54 due to the arrangement that the ink supply path in the liquid chamber 50 gradually increases from the portion where it is connected to the ink tank 10 (upstream), in other words, it is narrowed upward.

The recording head 20 includes the plurality of ejection ports 20A disposed in a predetermined direction (when, for example, a serial system, in which the recording head 20 is mounted on a member such as a carriage or the like as described above and executes an ejecting operation while moving relatively to a recording medium, is employed, a direction (right to left direction in the figure) opposite to the moving direction (direction perpendicular to the figure) of the head), liquid paths communicating with the respective ejection ports, and devices disposed in the liquid paths for generating energy used to eject ink. An ink ejection system in the recording head, that is, a mode of the energy generation device is not particularly limited here. For example, an electrothermal transducer, which generates heat according to energization, may be used as the device, and thermal energy generated thereby may be used to eject ink. In this case, ink is film-boiled by the heat generated by the electrothermal transducer, and the ink can be ejected from an ink ejection port by foaming energy generated at the time. Further, an electromechanical transducer such as a piezo element, which deforms according to a voltage applied thereto, may be used, and ink may be ejected making use of mechanical energy thereof.

The recording head 20 may be combined with the liquid chamber 50 so as to be separable or inseparable therefrom. Otherwise, they may be arranged separately and connected to each other through a communication path. When the recording head 20 is arranged integrally with the liquid chamber 50, they can be also arranged as a cartridge which can be mounted on and dismounted from a mounting member (for example, the carriage) in the recording apparatus.

Arrangement and Basic Operation of Connecting Section

The connecting section 51, which acts as a basis of the present invention, will be explained. The connecting section 51 is composed of a hollow-needle-like member the interior of which is divided into the two hollow portions (flow paths 53, 54) along an axial direction. The positions of the openings of the flow paths, which are located on an upper side, that is, the positions of the openings located in the ink accommodation chamber 12 (hereinafter, referred to as "tank side opening positions"), and the positions of the openings of the flow paths, which are located on a lower side, that is, the positions of the openings located in the liquid chamber coupled with the recording head (hereinafter, referred to as "head side opening positions") have a different height with respect to a vertical direction. More specifically, the tank side opening of the flow path 54 located on the left side in the figure is located at a position higher than the tank side opening of the flow path 53 located on the right side in the figure, and the head side opening of the flow path 53 is located at a position lower than the head side opening of flow path 54. Reasons of this arrangement will be described alter.

The flow path 53 whose tank side opening position in the ink accommodation chamber 12 and whose head side opening position in the liquid chamber 50 are located at relatively lower positions in the vertical direction is conveniently called an ink flow path. The flow path 54 whose tank side opening position in the ink accommodation chamber 12 and whose head side opening position in the liquid chamber 50 are located at relatively higher positions in the vertical direction is conveniently called an air flow path. This is because, in a bubble eliminating process, ink is mainly taken out from the ink flow path 53 to the recording head side, and air is mainly transferred from the air flow path 54 to the ink tank side. However, both the ink and the air move through the respective flow paths as described below. That is, the names of these flow paths do not always mean that the flow paths are used only by the fluids used in their names.

In the arrangement shown in FIG. 1, the tank side opening positions and the head side opening positions of the ink flow path 53 and the air flow path 54 have a relatively different height in the vertical direction, and the relatively different height of the tank side opening positions is provided to eliminate a multi-meniscus state to be described later. However, only the head side opening positions may have the relatively different height in the vertical direction and the tank side opening positions may have approximately the same height in order to execute a basic operation for transferring the gas remaining in the liquid chamber 50 to the tank side. This is because the gas (air) in the liquid chamber 50 moves to the ink tank 10 through the ink flow path 53 as well as ink is transferred from the ink tank 10 to the liquid chamber 50 through the ink flow path 53 according to the relation between a pressure difference generated by a water head of ink corresponding to the difference of the heights of the head side openings of the two flow paths in the vertical direction and a pressure difference generated by the meniscuses formed by the ink in the respective flow paths, and the like.

The basic operation will be explained in more detail using FIGS. 2 to 4. Note that since only the basic operation for transferring the ink in the liquid chamber 50 to the ink tank is explained in these figures, the tank side opening positions are set to approximately the same height.

Figure 2:
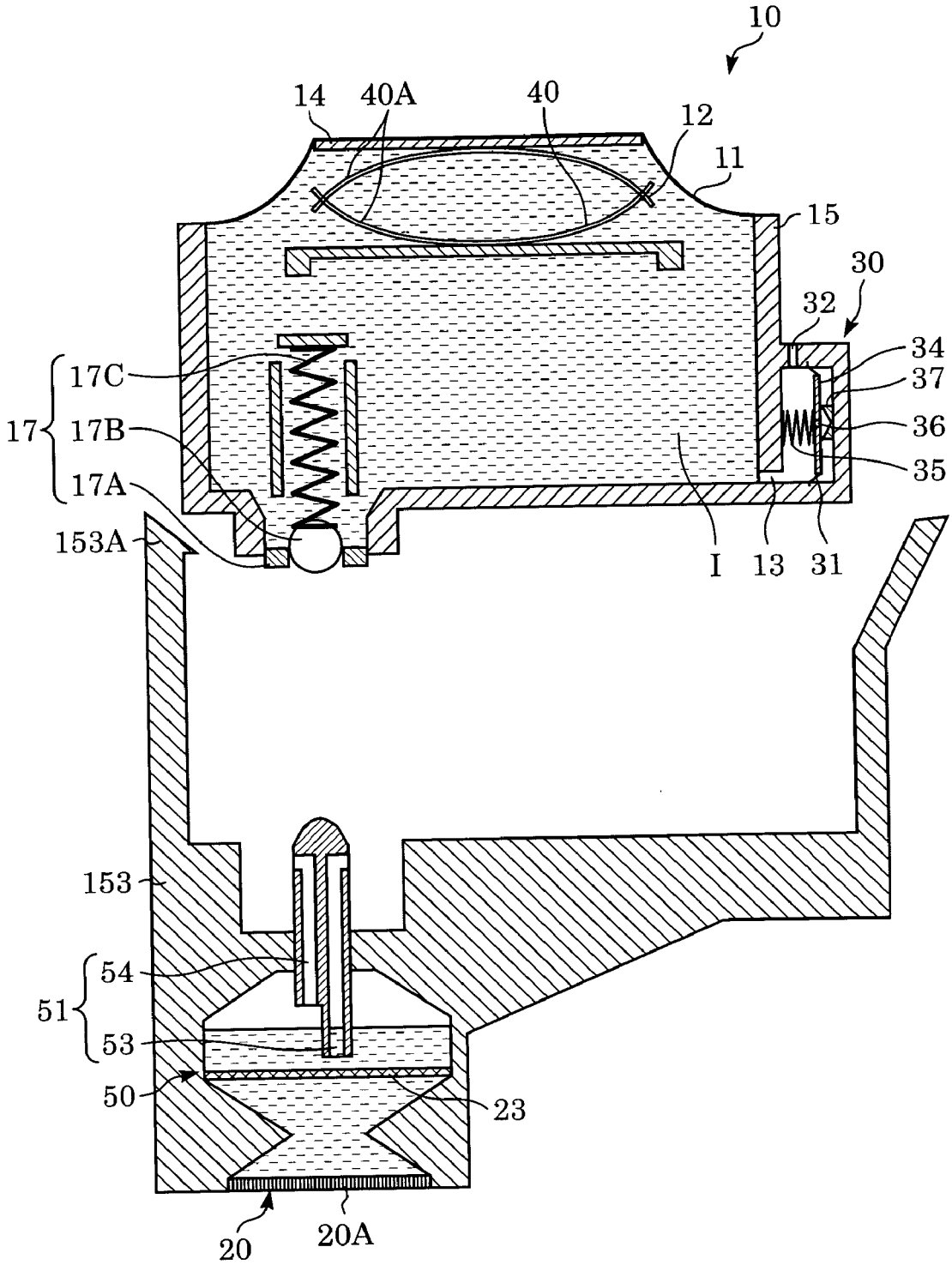
FIG. 2 is a schematic sectional view showing a state that a new ink tank is not mounted on an assembly of a liquid chamber and a recording head to explain a basic gas/liquid exchange process of the present invention.
Figure 3:
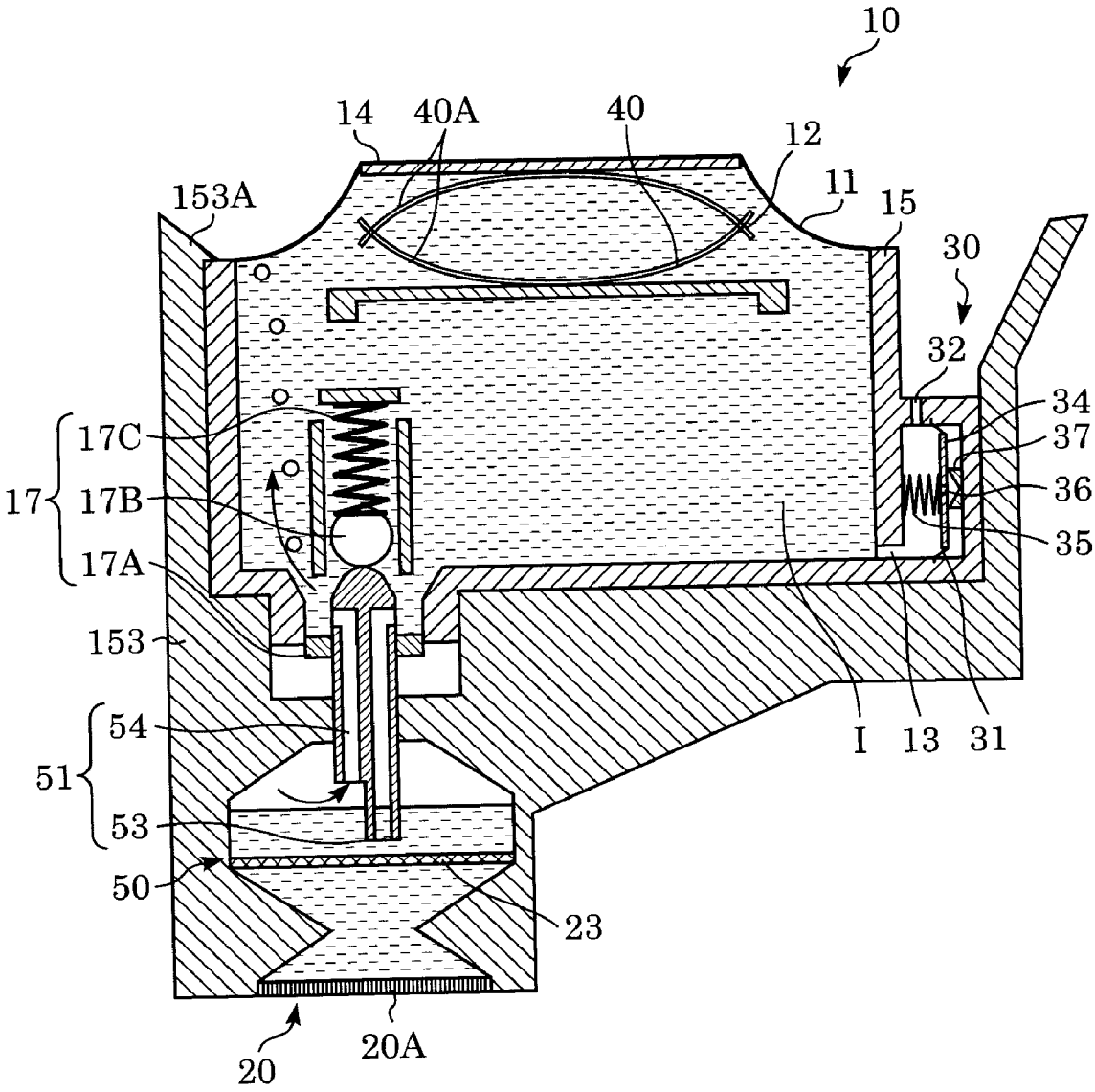
FIG. 3 is a schematic sectional view showing a state that the new ink tank is mounted and bubbles are discharged from the state shown in FIG. 2 to explain a basic gas/liquid exchange and gas elimination process of the present invention.
Figure 4:
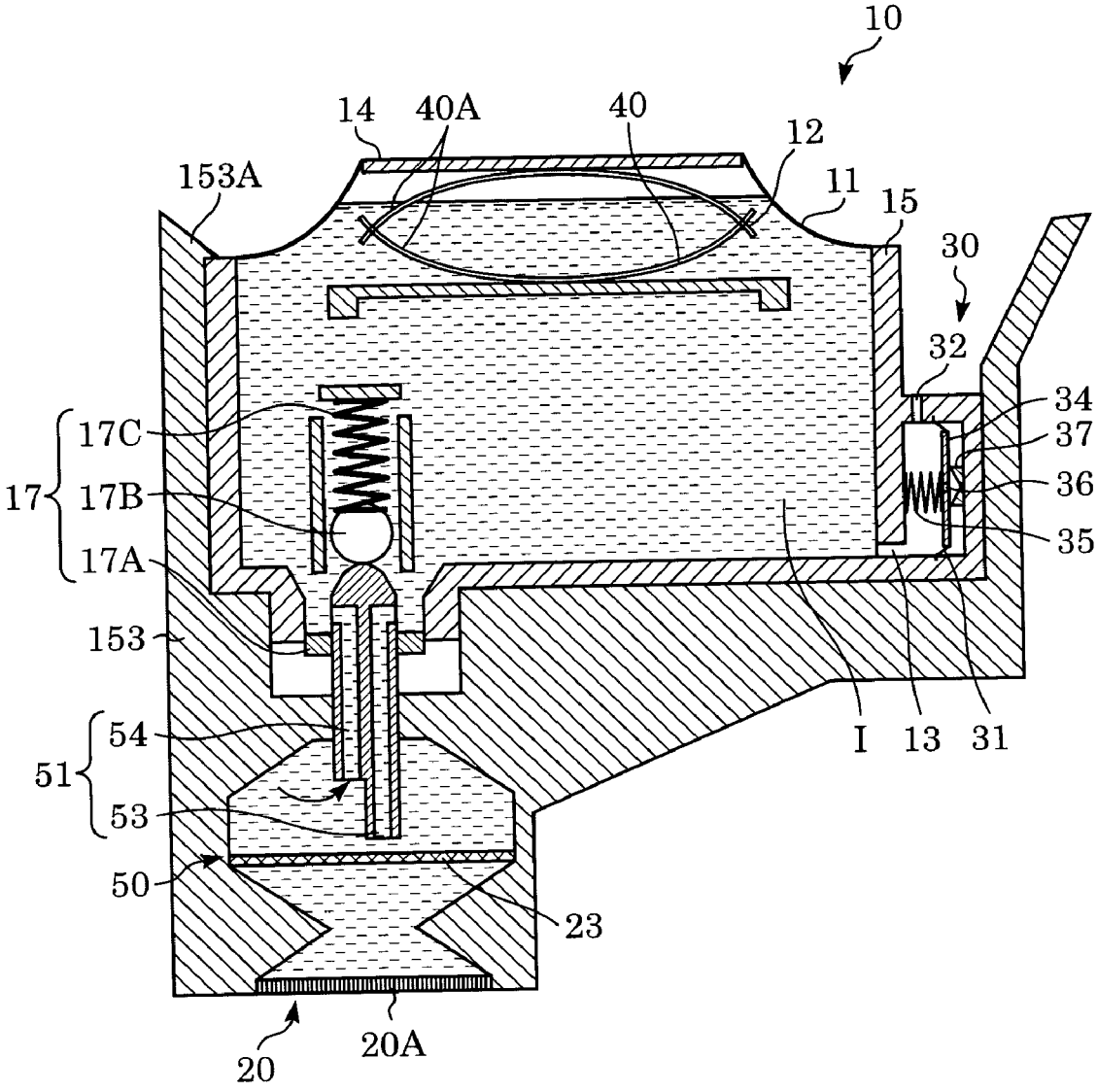
FIG. 4 is a schematic sectional view showing a state that a gas/liquid exchange operation is finished to explain the basic gas/liquid exchange process of the present invention.

FIGS. 2 to 4 show a process in which a new ink tank 10 is mounted, wherein FIG. 2 shows a state before the ink tank 10 is mounted, FIG. 3 shows a state that the air in the liquid chamber is being discharged, and FIG. 4 shows a state after the air is discharged, respectively.

In the state of FIG. 2, in which the ink tank 10 is not yet mounted on the assembly of the liquid chamber 50 and the recording head 20, the ink tank 10 is completely filled with the ink I, a negative pressure is generated by the spring member 40 as well as the sheet member 11 projects toward the outside of the ink tank. In contrast, recording is executed by the recording head 20 using the ink remaining in the liquid chamber 50 even if the ink tank 10 mounted up to that time becomes empty. Accordingly, air enters from the ink tank stays in a region upstream of the filter 23 in the liquid chamber 50.

When the ink tank 10 is mounted in this state, the air pressure in the region upstream of the filter 23 is equal to atmospheric pressure because the assembly of the recording head 20 and the liquid chamber 50 is opened to the atmosphere in the state of FIG. 2. In contrast, the interior of the ink tank 10 is kept to a pressure lower than an atmospheric pressure (negative pressure) by the spring member 40. With this arrangement, a part of the air in the region upstream of the filter 23 moves into the ink accommodation chamber 12 at the moment the ink tank 10 is mounted, thereby the pressure in the ink accommodation chamber 12 and the pressure in the liquid chamber 50 are averaged. A force, which intends to move the air remaining in the liquid chamber 50 to the ink tank 10 side through the air flow path 54, acts on the remaining air. Whereas, a force, which intends to move the ink in the ink accommodation chamber 12 to the liquid chamber 50 side through the ink flow path 53, acts on the ink by its own weight. Fundamentally, these forces move the air in the liquid chamber into the ink tank through the ink flow path and move the ink in the ink tank into the liquid chamber. However, in a certain condition, the air may not be moved only by mounting the ink tank. In this case, however, when ink is consumed by an operation for sucking ink from the ejection ports and an operation for ejecting ink therefrom after the ink tank is mounted, ink moves into the liquid chamber 50 and air is discharged to the ink tank 10 as shown in FIG. 3 according to the relation between a pressure generated by a difference of heights between the height from the liquid surface in the ink accommodation chamber to the head side opening of the air flow path 54 and the height up to the liquid surface in the liquid chamber (difference between water heads) and a pressure generated by a meniscus in the flow path. FIG. 4 shows a state that the air in the liquid chamber 50 has completely moved into the ink accommodation chamber 12. In this state, the movement of ink and the discharge of air is stopped. The basic gas/liquid exchange operation of the embodiment is executed promptly after the ink tank is mounted as well as removal of bubbles is completed thereby.

In the above arrangement, the tank side openings of the connecting section 51 are opened to the atmosphere when the ink tank is replaced. However, a seal member may be disposed to the recording head to hermetically seal the tank side openings of the connecting section 51 by sliding the connecting section as the ink tank is mounted. With this arrangement, the evaporation of ink from the openings can be prevented when the ink tank is not mounted, and thus clogging due to an increase in viscosity of ink can be prevented. In this case, the interior of the liquid chamber 50 may be kept in a negative pressure when the ink tank is dismounted, and the negative pressure in the liquid chamber 50 may be higher than that in the ink tank when the new ink tank is mounted.

At this time, when the ink tank is mounted, air does not move from the liquid chamber to the ink tank through the air flow path as described above. On the contrary, however, ink moves from the ink tank to the liquid chamber through the air flow path, thereby a multi-meniscus state in the air flow path can be eliminated. In any case, since the tank side opening position of the air flow path is located above the tank side opening position the ink flow path in the vertical direction, the multi-meniscus state in the air flow path can be selectively eliminated when the ink tank is mounted.

As described above, since the air in the liquid chamber 50 is discharged when the new ink tank 10 is mounted, no air is guided to the recording head 20, and air is allowed to flow into the liquid chamber 50 to a certain extent. Accordingly, there can be obtained an excellent effect that the ink in the ink tank 10 can be almost completely consumed.

Problems of Multi-Meniscus State

However, there is a possibility of occurrence of a phenomenon by which the basic gas/liquid exchange operation is inhibited and the transfer of air built up in the liquid chamber is delayed.

The phenomenon will be explained using FIG. 5.

Figure 5:
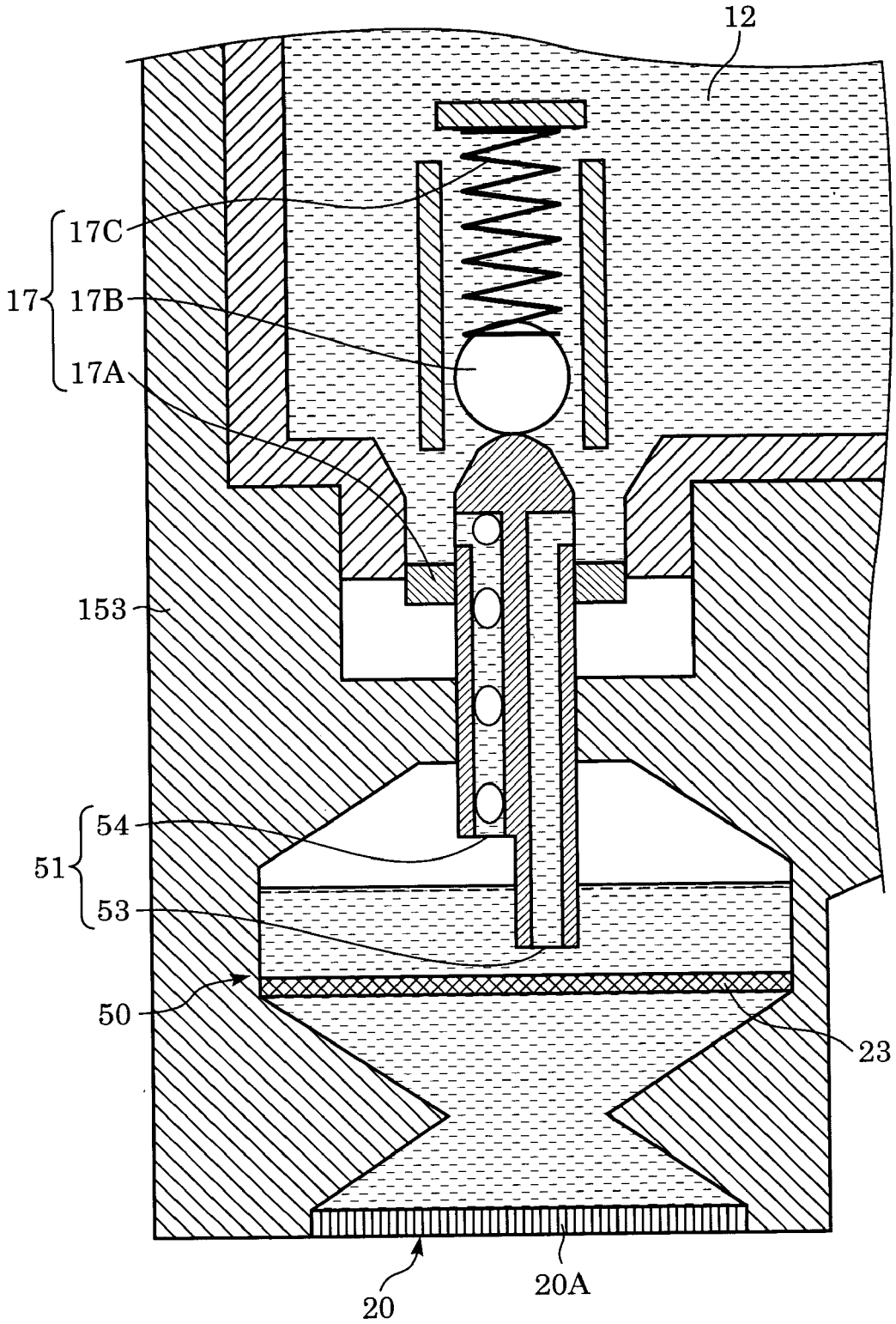
FIG. 5 is a schematic sectional view for explaining a multi-meniscus state in an air flow path which inhibits the basic gas/liquid exchange operation of the present invention.

FIG. 5 shows a state that the ink accommodation chamber 12 communicates with the liquid chamber 50 through the connecting section 51. The ink flow path 53 is in a perfectly liquid communicating state. However, since air partly remains in the air flow path 54, air (gas) and ink (liquid) are intermittently connected to each other as if they form a tiger tail pattern, thereby meniscuses are formed in a multiple state in the ink flow path 53. The above state is called an intermittent gas/liquid state or a multi-meniscus state.

As described above, the force, which moves the air remaining in the liquid chamber 50 to the ink tank 10 side through the air flow path 54, acts on the remaining air, and the force, which moves the ink in the ink accommodation chamber 12 to the liquid chamber 50 side, acts on the ink by its own weight. However, when the interior of the air flow path is in the multi-meniscus state and thus a pressure generated by meniscuses is larger than a pressure which intends to cause an ink/air movement, the transfer of air is delayed.

A case that the interior of the air flow path 54 ink accommodation space is made to the multi-meniscus state will be explained.

When a recording operation is still executed even if the ink in the ink tank 10 is made almost empty, air is sucked from the ink tank 10 side into the liquid chamber 50 in a process in which the ink is consumed, and thus both the ink flow path 53 and the air flow path 54 are placed in the multi-meniscus state. That is, the lowermost surface in the vertical direction of the ink tank 10 being mounted is in an almost horizontal state. In this state, when the tank side openings of both the flow paths 53, 54 are located in the vicinity of the lowermost surface, ink and air are simultaneously sucked into both the flow paths 53, 54 just before the ink in the ink tank 10 has been completely consumed, thereby both the flow paths are liable to be placed in the multi-meniscus state. Since a pressure resistance increases in proportion to the number of meniscuses in the flow paths, a flow path having a smaller number of meniscuses has a lower pressure resistance, and thus air is liable to move through the flow path having the smaller number of meniscuses.

Figure 6A:
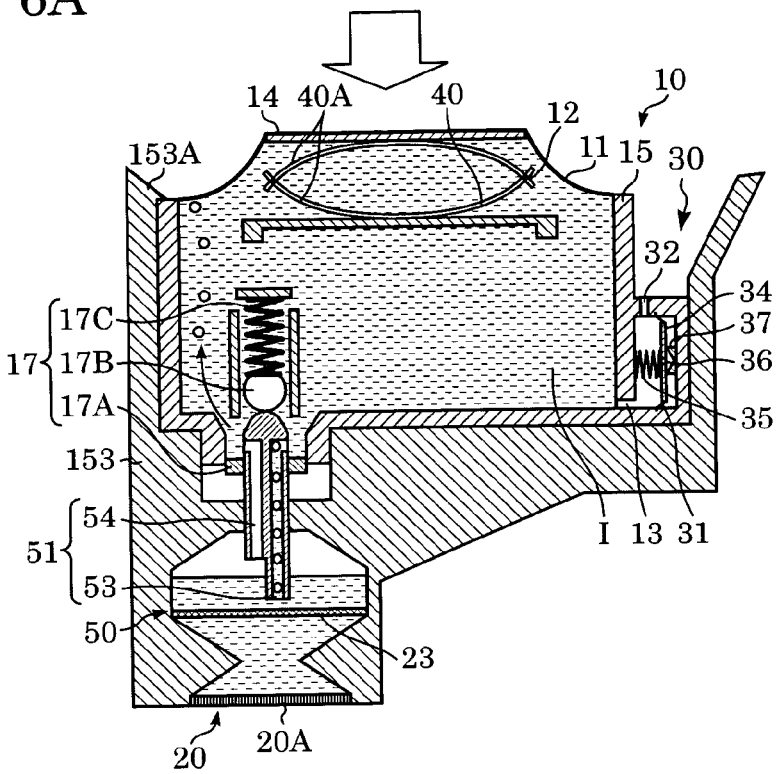
FIGS. 6A and 6B are schematic sectional views for explaining an operation when the multi-meniscus state is not eliminated in an ink flow path and the air flow path, respectively.
Figure 6B:
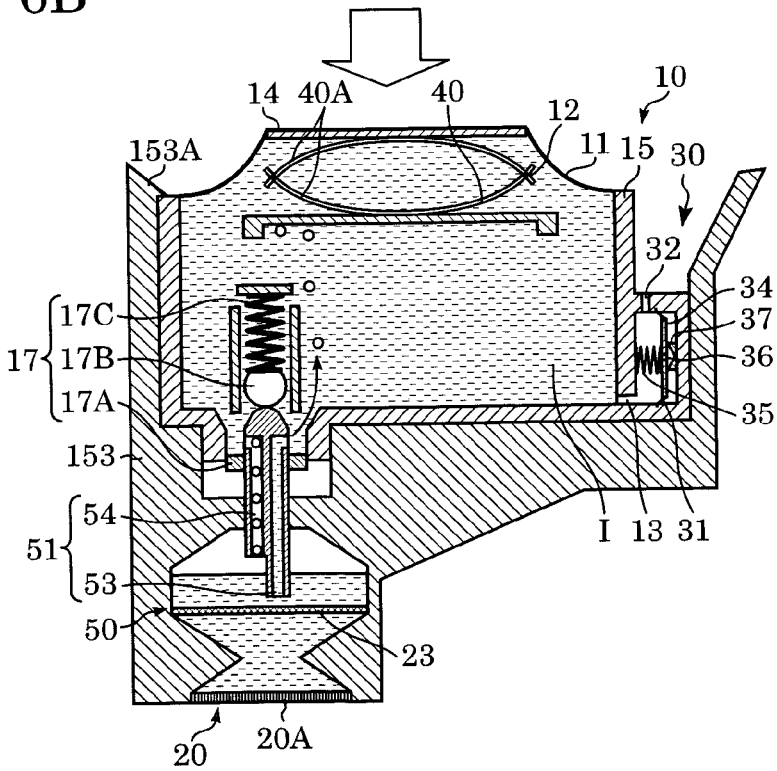

A case that the flow path having the lower pressure resistance described above is the air flow path 54 and a case that it is the ink flow path 53 will be examined based on FIGS. 6A and 6B.

FIG. 6A shows an operation executed when the new ink tank is mounted in the case that the air flow path 54 has the lower pressure resistance. After the ink tank is mounted, at least a part of the air in the region upstream of the filter 23 is caused to pass through the air flow path 54 by the negative pressure in the ink accommodation chamber 12 and guided into the ink accommodation chamber 12. Accordingly, the multi-meniscus state in the air flow path 54 is eliminated. In contrast, the multi-meniscus state is maintained in the ink flow path 53. That is, ink is consumed by the recording head 20 in this state.

When, however, the ink is consumed by the recording head 20, a negative pressure is generated in the liquid chamber 50 as the ink is consumed because the head side opening of the ink flow path 53 is in contact with the ink in the liquid chamber 50. Although the pressure in the ink flow path 53 increases, almost no problem arises as to an ink movement, and ink is supplied from the ink accommodation chamber 12. Accordingly, the multi-meniscus state in the ink flow path 53 will be eliminated soon. Further, even if air other than the air moved just after the ink tank is mounted remains in the ink flow path 53, all the remaining ink is transferred to the ink tank because the gas/liquid exchange is executed by the initial consumption of ink after the ink tank is mounted.

In contrast, FIG. 6B shows a state when the new ink tank 10 is mounted in the case that the ink flow path 53 has the lower pressure resistance. Fluids (ink and air) are sucked into the ink accommodation chamber 12 through the ink flow path 53 by the negative pressure in the ink accommodation chamber 12 just after the ink tank 10 is mounted, thereby the multi-meniscus state in the ink flow path 53 is eliminated. However, the multi-meniscus state in the air flow path 54 is not eliminated.

When ink is consumed by the recording head 20 in this state, a negative pressure is generated in the liquid chamber 50. However, the negative pressure in the liquid chamber 50 is eased as ink is supplied from the ink accommodation chamber 12. At the time, the ink from the ink accommodation chamber 12 passes through the ink flow path 53 having the lower pressure resistance. Thereafter, ink is supplied to the recording head 20 while repeating an increase in the negative pressure in the liquid chamber due to the consumption of ink and the introduction of ink from the ink tank 10 through the ink flow path 53 due to the increase in the negative pressure. Accordingly, air and ink do not pass through the air flow path 54 until the ink in the ink accommodation chamber 12 has been completely consumed. That is, the multi-meniscus state in the air flow path 54 having the high pressure resistance is not eliminated when the ink tank is used, and thus air remains stayed in the region upstream of the filter 23.

Characteristic Arrangement and Operation of First Embodiment

Accordingly, in the present invention, the multi-meniscus state particularly in the air flow path is eliminated and the basic gas/liquid exchange operation is securely executed so that built-up air can be smoothly and promptly transferred. For this purpose, in the first embodiment, the heights of the tank side openings of both the flow paths are also provided with a difference of heights in the vertical direction.

A process for eliminating bubbles to the ink tank of the embodiment arranged as shown in FIG. 1 will be explained in detail using FIGS. 7 to 12.

Figure 7:
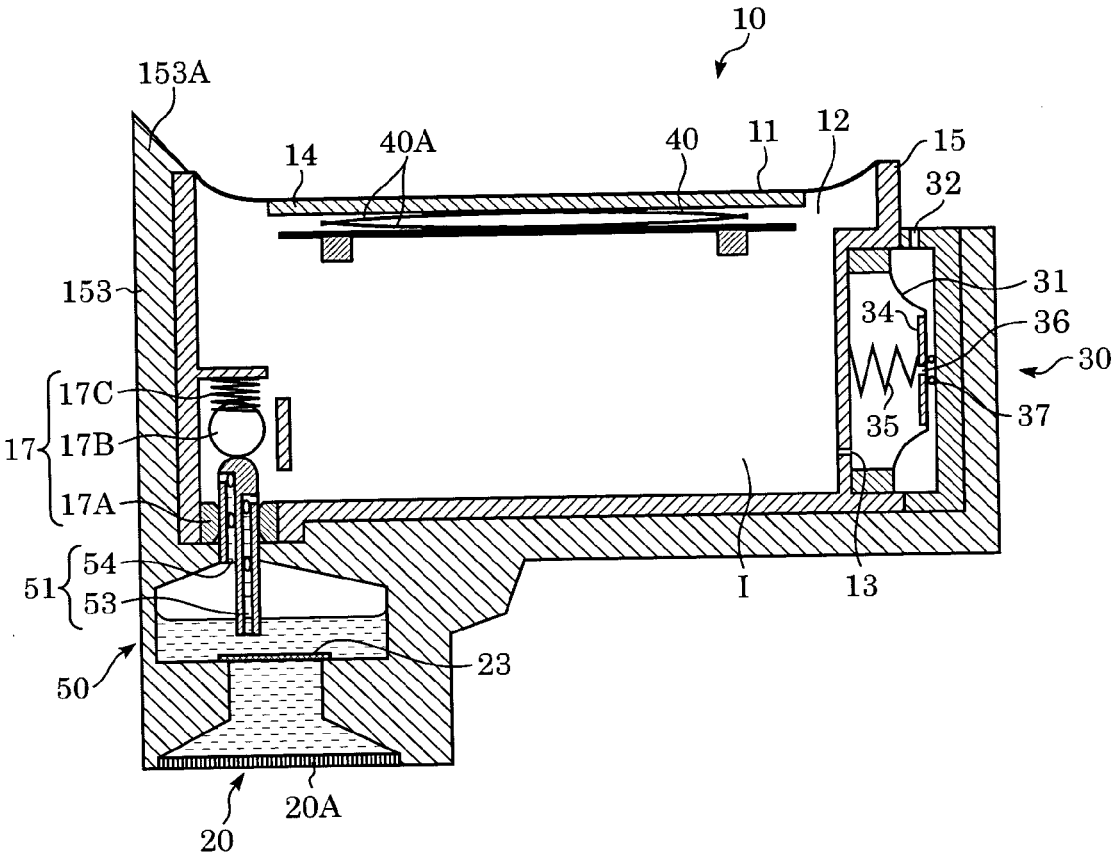
FIG. 7 is a schematic sectional view showing a state that ink in the ink tank has been completely consumed and a communication path is placed in a multi-meniscus state to explain the gas/liquid exchange process in the first embodiment.

First, FIG. 7 shows a state that the ink in the ink tank 10 has been completely consumed. At the time, although the deformation of the spring member 40 is maximized, the air pressure in the ink tank 10 is managed to a pressure lower than an atmospheric pressure by a pressure determined by the spring member 35 and the pressure plate 34 in the valve chamber 30 by the action of the valve chamber 30 acting as the one-way valve. Further, since the recording operation is still being executed even if the ink in the ink tank 10 is made almost empty, air is sucked from the ink tank 10 side into the liquid chamber 50 in a process in which the ink is consumed, and thus both the ink flow path 53 and the air flow path 54 are placed in the multi-meniscus state.

Figure 8:
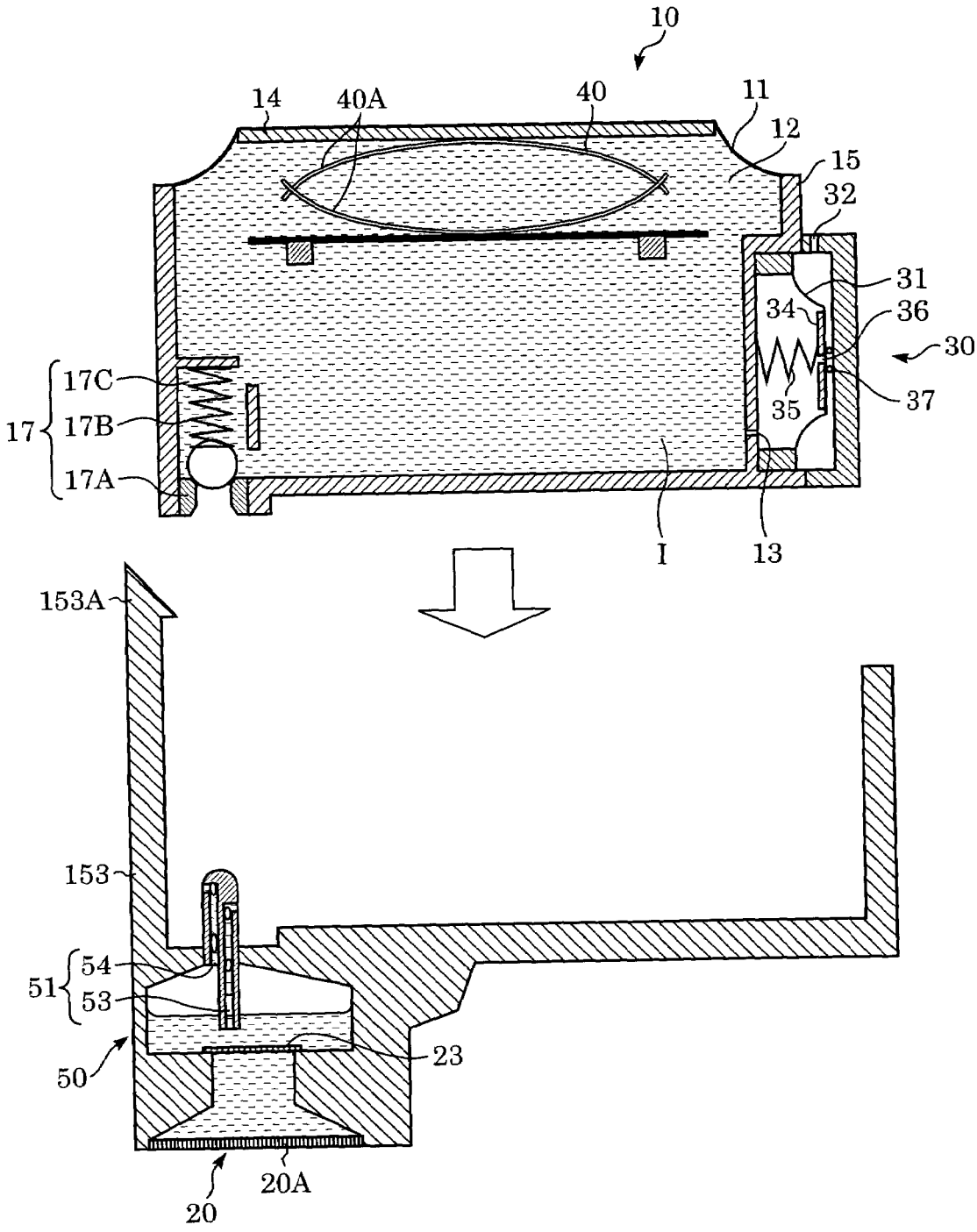
FIG. 8 is a schematic sectional view showing a state that the new ink tank is not mounted on the assemble of the liquid chamber and the recording head to explain a gas/liquid exchange process in the first embodiment.

FIG. 8 is a view showing a state just before the new ink tank 10 is mounted after the empty ink tank is dismounted. The ink tank 10 is completely filled with the ink I, a negative pressure is generated by the spring member 40, and the sheet member 11 projects toward the outside of the ink tank.

Figure 9:
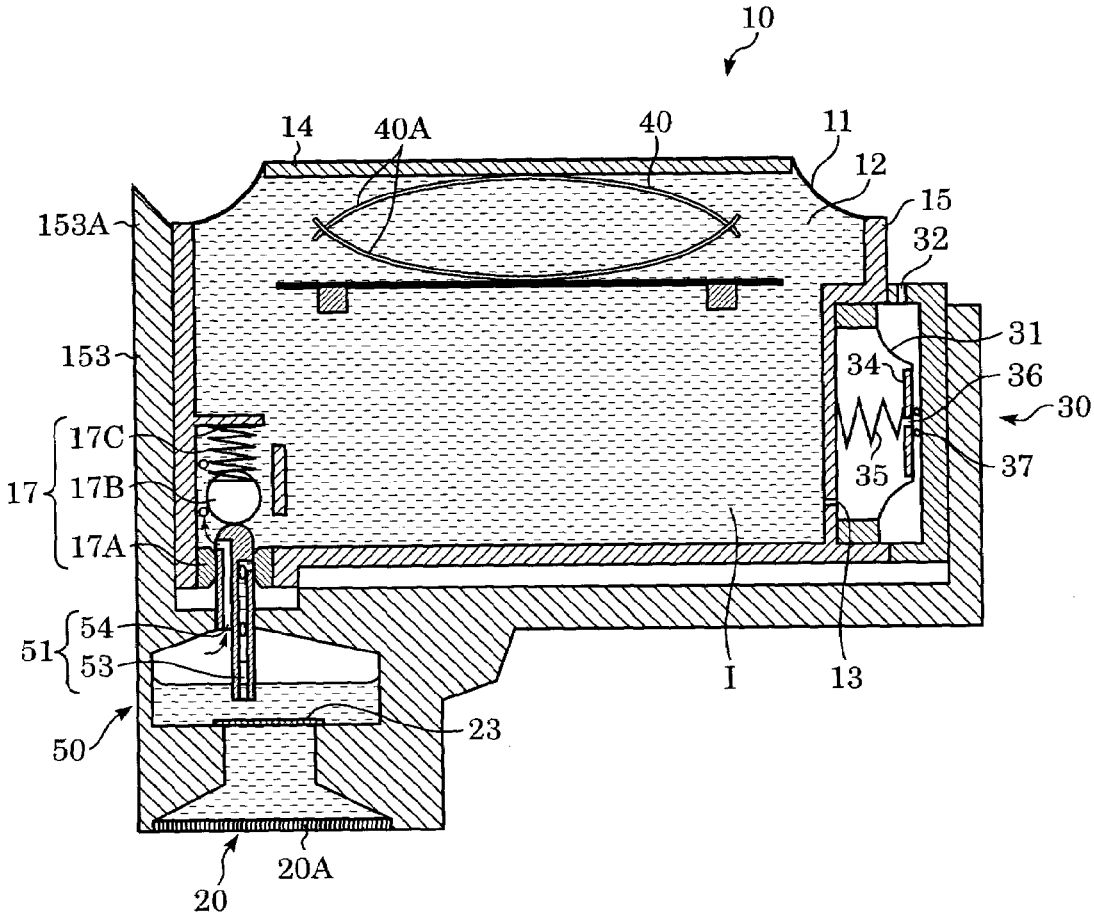
FIG. 9 is a schematic sectional view showing a state before the new ink tank has been completely mounted from the state of FIG. 8 to explain the gas/liquid exchange process in the first embodiment.

FIG. 9 shows a state just before the mounting of the new ink tank 10 is completed after it begins to be mounted from the state shown in FIG. 8. That is, the tank side opening of the air flow path 54 is pierced into the ink accommodation chamber 12 first because the position of the opening is relatively high and communicates with the ink accommodation chamber 12. However, since the tank side opening of the ink flow path 53 does not yet reach the interior of the ink accommodation chamber 12, the ink flow path 53 does not communicate with the ink accommodation chamber 12. Since the assembly of the recording head 20 and the liquid chamber 50 is opened to the atmosphere in the state of FIG. 8, the air pressure in the region upstream of the filter 23 is equal to an atmospheric pressure. In contrast, the interior of the ink tank 10 is set to a pressure lower than the atmospheric pressure (negative pressure) by the spring member 40.

In the arrangement that the positions of the tank side openings of the ink flow path 53 and the air flow path 54 have approximately the same height in the vertical direction, a fluid moves in a flow path having a smaller number of meniscuses, that is, having a lower pressure resistance as described in FIGS. 6A and 6B, and thus the multi-meniscus state in the flow path is eliminated. When the air flow path 54 has a higher pressure resistance, the multi-meniscus state in the ink flow path 53 is eliminated, and the multi-meniscus state in the air flow path 54 is not eliminated and remains therein.

In contrast, in the embodiment, the tank side opening of the air flow path 54 is pierced into the ink accommodation chamber 12 prior to the tank side opening of the ink flow path 53, thereby only the air flow path 54 communicates with the ink accommodation chamber 12. Accordingly, in the state shown in FIG. 9 in which the ink tank 10 has not been completely mounted, a part of the air in the region upstream of the filter 23 moves into the ink accommodation chamber 12 and builds up in an upper portion thereof. Accordingly, the pressure in the ink accommodation chamber 12 and the pressure in the liquid chamber 50 are averaged. More specifically, since the position of the tank side opening of the air flow path 54 is located above the position of the tank side opening of the ink flow path 53, the ink accommodation chamber 12 communicates with the liquid chamber 50 first through the air flow path 54 in the process of mounting the ink tank 10 and gas and air begin to move, thereby the multi-meniscus state in the air flow path 54 is eliminated.

Thereafter, when the ink tank 10 is mounted finally or before the tank side opening of the ink flow path 53 is also positioned in the ink accommodation chamber 12, the ink flow path 53 also communicates with the ink accommodation chamber 12. However, since the air flow path 54 already communicates with the ink accommodation chamber 12 and a gas movement occurs, movement of gas or ink through the ink flow path 53 may not occur. That is, what is important here resides in that when the tank side opening of the ink flow path 53 is also positioned in the ink accommodation chamber 12, the movement of gas or ink through the ink flow path 53 depends on the negative pressure in the ink flow path 53 and the state of the liquid chamber 50. However, since the air flow path 54 communicates with the ink accommodation chamber 12 prior to the ink flow path 53, gas or ink securely moves therethrough, thereby the multi-meniscus state in the air flow path is eliminated.

However, when the ink flow path 53 of the connecting section 51 is in the multi-meniscus state and the pressure in the ink flow path 53 balances a force which intends to move ink by its own weight, the movement of gas through the air flow path stops. The elimination of gas may be completed in this state depending on a volume of gas on the supply section side. However, the gas in the illustrated case has a large volume, there still remains gas to be eliminated.

Figure 10:
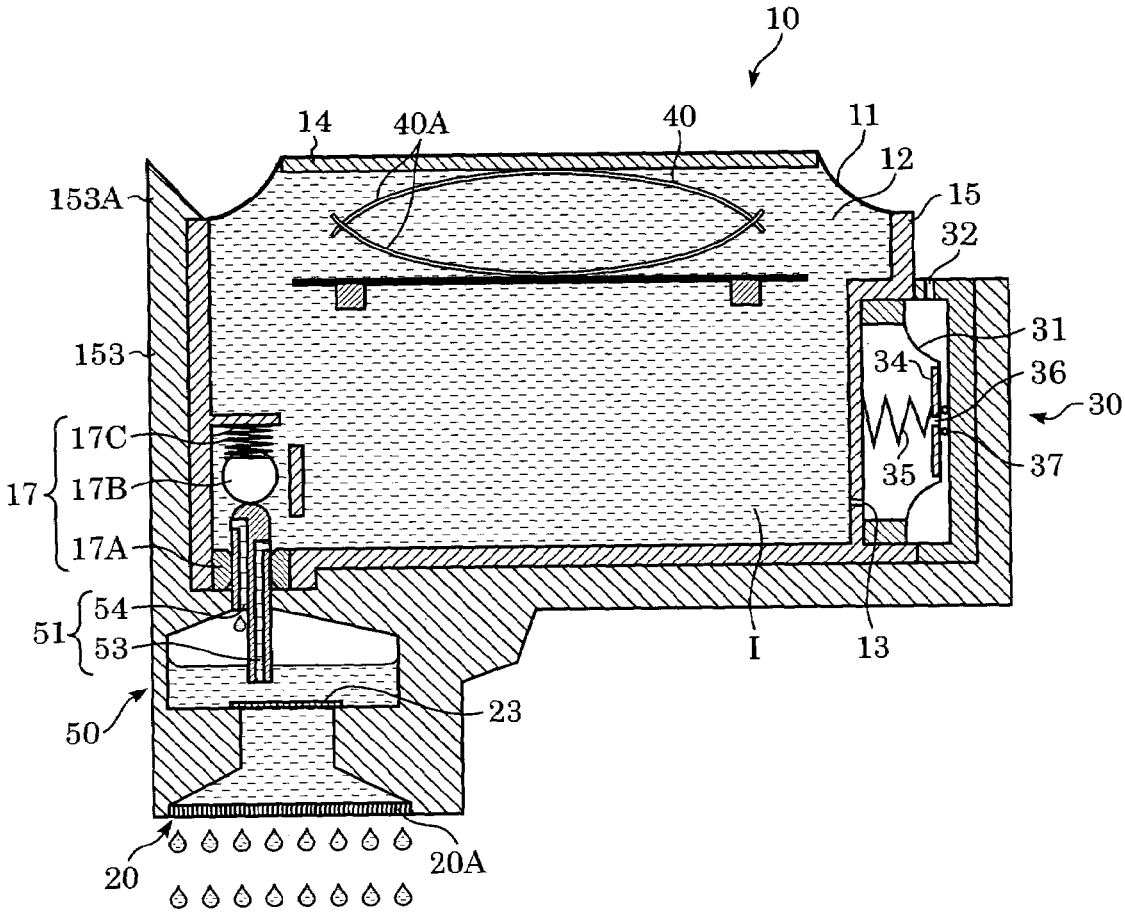
FIG. 10 is a schematic sectional view showing a state that ink is ejected or discharged from the recording head after the new ink tank has been completely mounted to explain the gas/liquid exchange process in the first embodiment.

FIG. 10 schematically shows a state that ink is ejected as, for example, drops from the recording head 20 after the mounting of the ink tank 10 is completed by engaging the exterior 15 with the latch 153A of the carriage 153. When the ink is ejected, since the negative pressure in the assembly of the recording head 20 and the liquid chamber 50 increases, the meniscuses of the ink formed in the connecting section 51 are broken, and thus the ink moves from the ink tank 10 to the liquid chamber 50. With the above operation, the inside volume of the ink accommodation chamber 12 decreases, and the sheet member 11 deforms downward while being regulated by the pressure plate 14. Accordingly, the spring member 40 is compressed and the negative pressure in the ink accommodation chamber 12 also increases.

In the embodiment, since the ink flow path 53 and the air flow path 54 have approximately the same tube diameter, almost the pressure losses generated in these flow paths do not have a large difference with respect to the negative pressure in the assembly of the recording head 20 and the liquid chamber 50, and thus ink is supplied from the respective flow paths. In the illustrated state that the head side opening of the ink flow path 53 is in contact with ink, the ink flows in from the ink flow path 53 as it is, the bubbles generated in the assembly of the liquid chamber 50 and the recording head 20 move to the region upstream of the filter and build up in the region, i.e. in an upper portion of the liquid chamber 50 together with remaining gas. Although the ink forms meniscuses in this state at the position of the head side opening of the air flow path 54, the ink drops when the negative pressure in the assembly of the recording head 20 and the liquid chamber 50 is high. Note that, in the embodiment, the connecting section 51 is filled with ink because the ink is ejected in a recording operation or in an operation other than the recording operation (preliminary ejection). However, this state may be also achieved by sealing the ejection port forming surface of the recording head 20 with a cap member and discharging ink from the ejection ports by a suction pump.

At the time, the state shown in FIG. 9 can be shifted to the state shown in FIG. 10 because the multi-meniscus state in the air flow path 54 is eliminated in FIG. 9. However, a case that the air flow path 54 remains in the multi-meniscus state will be examined here. That is, this is a case that ink is consumed by the recording head 20 when both the air flow path 54 and the ink flow path 53 are in the multi-meniscus state. At the time, since the head side opening of the ink flow path 53 is in contact with the ink in the liquid chamber 50, it is not necessary to break meniscuses even if a negative pressure is generated in the liquid chamber 50 as the ink is consumed and the ink moves. That is, although a pressure resistance is generated in an initial ink movement due to the multi-meniscus state, no problem arises in the ink movement, and the multi-meniscus state in the ink flow path is eliminated finally. However, since the air flow path is in contact with gas at the head side opening position thereof, meniscuses must be broken, thereby a pressure resistance is increased. At the time, an amount of ink to be consumed is covered by the ink which moves in the ink flow path, the pressure in the liquid chamber 50 is eased even if no ink is supplied from the air flow path, and thus the multi-meniscus state in the air flow path may remain in an uneliminated state, by which the basic gas/liquid exchange operation described above is inhibited.

Accordingly, it is possible to securely shift from the state of FIG. 9 to the state of FIG. 10 and to subsequent states by obtaining the state of FIG. 9 and eliminating the multi-meniscus state in the air flow path 54 in advance.

Figure 11:
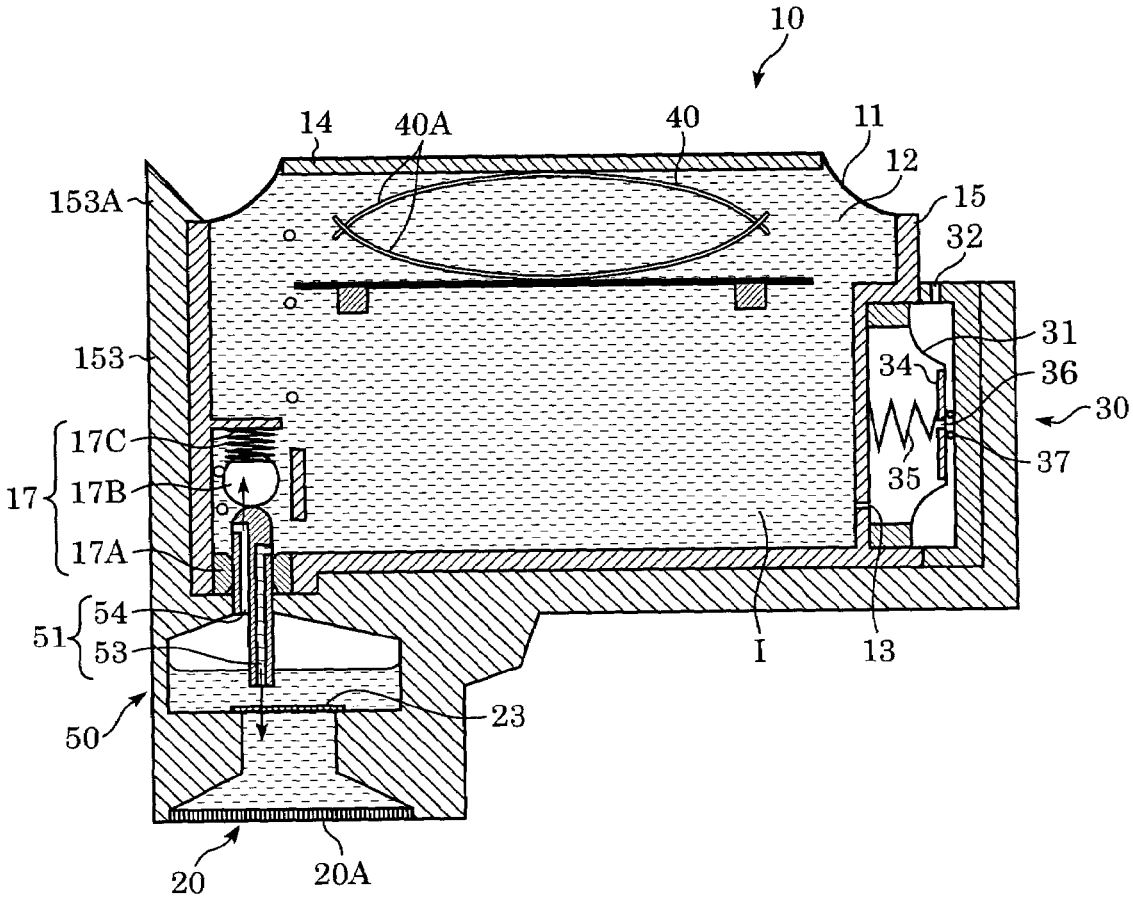
FIG. 11 is a schematic sectional view showing a state that movement of ink and discharge of gas are executed at the same time after the ejection or discharge of ink stops to explain a gas elimination process in the first embodiment.

FIG. 11 shows a state that the ejection of ink or the suction of ink from the ejection port forming surface stops. In this state, a force, which causes ink to flow into the liquid chamber 50, is generated in the ink flow path 53 by a difference of water head, and a force, which causes air to be discharged to the ink tank 10 side, is generated in the air flow path 54. Although these states will be theoretically explained later, ink is moved into the liquid chamber 50 and air is discharged to the ink tank 10 side by these forces at the same time as shown in FIG. 11.

Figure 12:
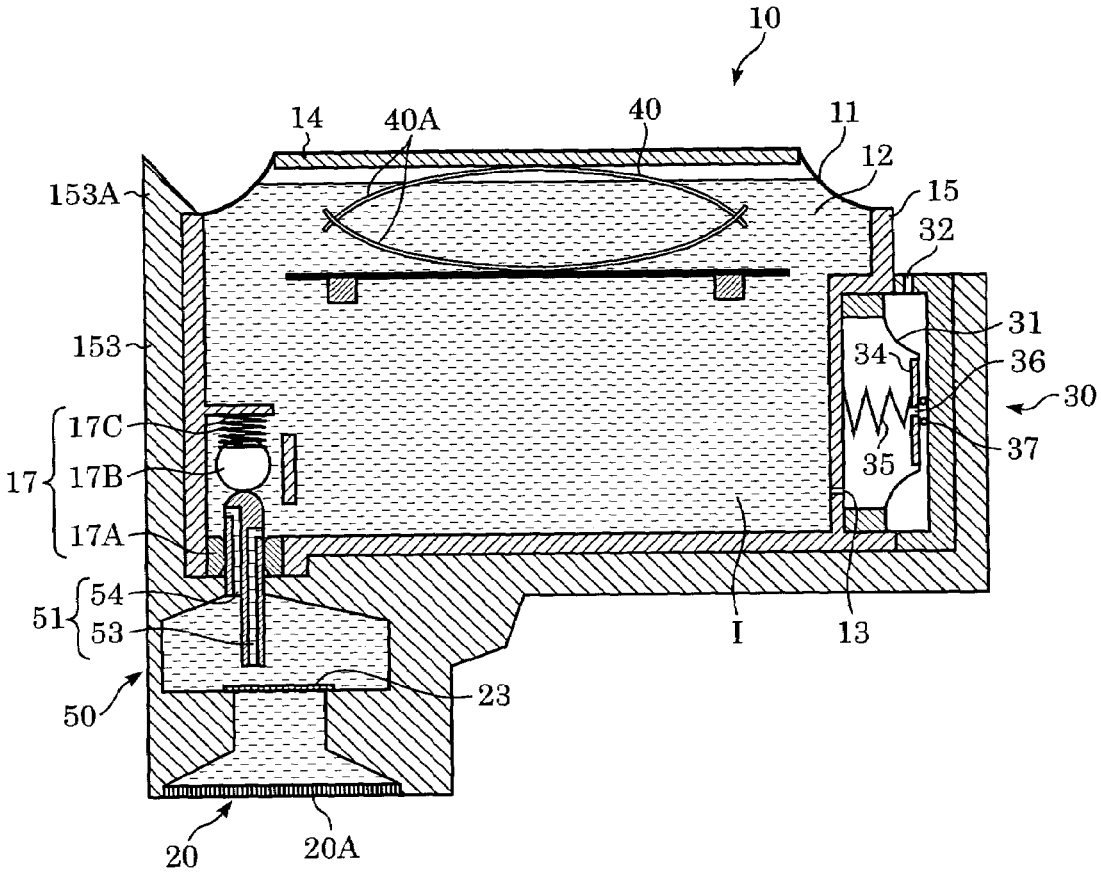
FIG. 12 is a schematic sectional view showing a state that the movement of the ink and the discharge of the gas stop to explain the gas elimination process in the first embodiment.

FIG. 12 shows a state that the air in the liquid chamber 50 has completely moved into the ink accommodation chamber 12. In this state, the movement of ink and the discharge of air stop.

Principle of Gas/Liquid Exchange

Figure 13:
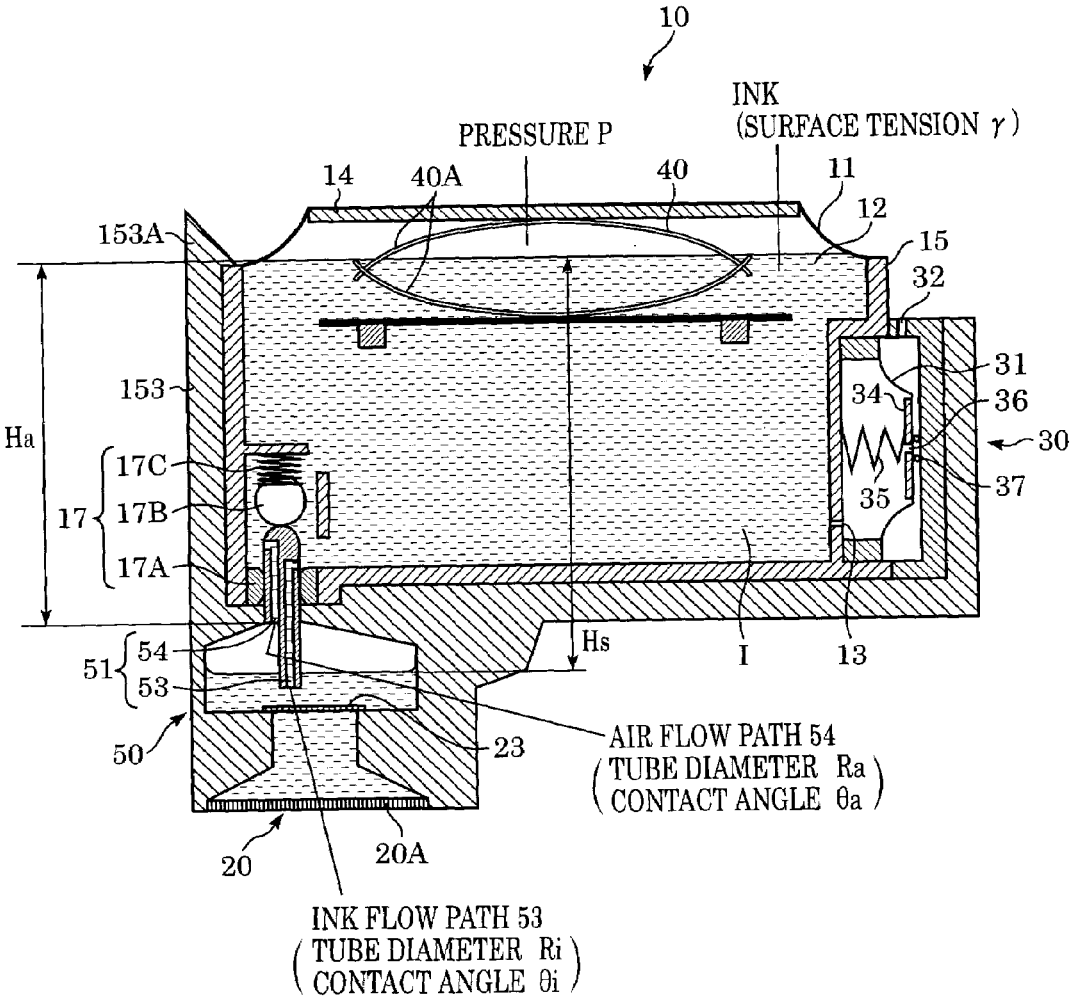
FIG. 13 is an explanatory view for explaining a principle of an ink movement and a gas discharge.

A pressure balance in respective sections will be explained using FIG. 13. FIG. 13 shows a state that the negative pressure in the liquid chamber is increased by the initial consumption of ink after the ink tank 10 mounted as explained in FIG. 10, the respective flow paths are willed with ink, and the basic gas/liquid exchange operation as shown in FIG. 11 starts. It is assumed that this state remains stationary for the convenience of explanation.

A pressure of the air built up in the region upstream of the filter 23 will be examined. When a pressure of bubbles in the ink accommodation chamber 12 is shown by P, a pressure generated by a difference of water heads between the ink interface in the ink accommodation chamber 12 and the ink interface in the region upstream of the filter 23 is shown by Hs, a pressure of the air in the region upstream of the filter 23 is shown by P+Hs that is larger than the pressure of the gas in the ink accommodation chamber 12 by Hs. This increase in pressure is due to the assembly of the liquid chamber 50 and the recording head 20 being arranged as the hermetically-sealed structure, and not due to an arrangement that an atmosphere communication port is interposed between the ink tank 10 and the recording head 20 as in the conventional art described above (for example, the patent document 1).

Next, when a pressure balance at a meniscus position of the head side opening of the air flow path 54 is examined, a downward acting pressure is shown by P+Ha, and an upward acting pressure is shown by the air pressure P+Hs described above. Since it is assumed that the former pressure balances the latter pressure in this state, a pressure difference in an up/down direction balances a pressure Ma due to meniscus shown by the following expression.

$$Ma=2_{\gamma}i\cos\theta a/Ra \quad (1)$$

where, $_{\gamma}i$ is surface tension of ink, θa shows a contact angle of ink to the air flow path 54, and Ra shows a diameter (inside diameter) of the air flow path 54.

Accordingly, the pressure balance at the position of the opening of the air flow path 54 on the head side is shown by the following expression.

$$P+Hs-(P+Ha)=Ma \quad (2)$$

$$Hs-Ha=Ma \quad (3)$$

That is, this is a state that the pressure generated by a difference of water heads between the meniscus position of the air flow path 54 and the ink interface in the region upstream of the filter 23 balances the pressure generated by the meniscuses in the air flow path 54. When a volume of the gas remaining in the region upstream of the filter increases from the above state, and the following expression (4) is satisfied, the gas in the region upstream of the filter has a high pressure.

$$Hs-Ha>Ma \quad (4)$$

Accordingly, the meniscuses in the air flow path 54 start to move to the ink accommodation chamber 12 side, thereby air moves to the ink accommodation chamber 12 side. Further, with the above operation, the ink in the ink accommodation chamber 12 moves into the liquid chamber 50 through the ink flow path 53, and thus a position of the ink surface in the liquid chamber rises.

Since the air flow path 54 has a volume substantially smaller than that of the liquid chamber 50, the ink liquid surface in the liquid chamber, which has a relatively large volume, minimally rises in an initial stage in which air starts to move. In contrast, the meniscus position of the air flow path 54 promptly moves toward the position of the tank side opening thereof. Accordingly, a pressure (Hs−Ha) due to a difference of water heads from the tank side opening position of the air flow path 54 to the ink interface position in the region upstream of the filter 23 is made considerably larger than the pressure generated by the meniscuses in the air flow path 54, thereby the discharge of air is accelerated.

When air is introduced into the ink tank, the meniscus position in the air flow path 54 is in coincidence with the position of the tank side opening of the air flow path. When a pressure generated by a difference of water heads at the tank side opening position is shown by Ha', air moves as long as the following expression (5) is satisfied.

$$Hs-Ha'>Ma' \quad (5)$$

where, Ma' shows a meniscus pressure formed at the tank side opening position the air flow path. When, however, the following expression (6) is satisfied before the ink interface in the region upstream of the filter reaches the head side opening position of the air flow path, an air movement stops at the time.

$$Hs-Ha'<Ma' \quad (6)$$

However, when the ink interface in the region upstream of the filter reaches the head side opening position of the air flow path 54 while satisfying the expression (5), the meniscus pressure formed in the head side opening of the air flow path also gets involved in the pressure balance. Accordingly, when the following expression (7) is satisfied, the air movement stops.

$$La<Ma+Ma' \quad (7)$$

where, La shows a pressure generated by a difference of water heads corresponding to a length of the air flow path.

However, the air movement does not stop when the following expression (8) is satisfied, and further the ink interface rises in the air flow path.

$$La>Ma+Ma' \quad (8)$$

When the ink interface moves in the air flow path, the air movement is executed until a state shown in FIG. 12 is achieved as long as the following expression (9) is satisfied.

$$Hs'-Ha'>Ma'+Ms' \quad (9)$$

where, Hs' shows a pressure generated by a difference of water heads between the ink interface in the air flow path and the ink interface in the tank, and Ms' shows a dynamic meniscus pressure generated to the ink interface in the ink flow path. A contact angle of ink to a flow path is different between a dynamic state and a static state. Accordingly, a value of Ma examined at the start of the air movement is different from a value of dynamic Ms' even if tubes have the same diameter, which results in Ma>Ms'.

Arrangement Applicable to Embodiment

Next, an ink tank replacement state for causing the arrangement of the above embodiment to more effectively function will be explained.

Figure 14:
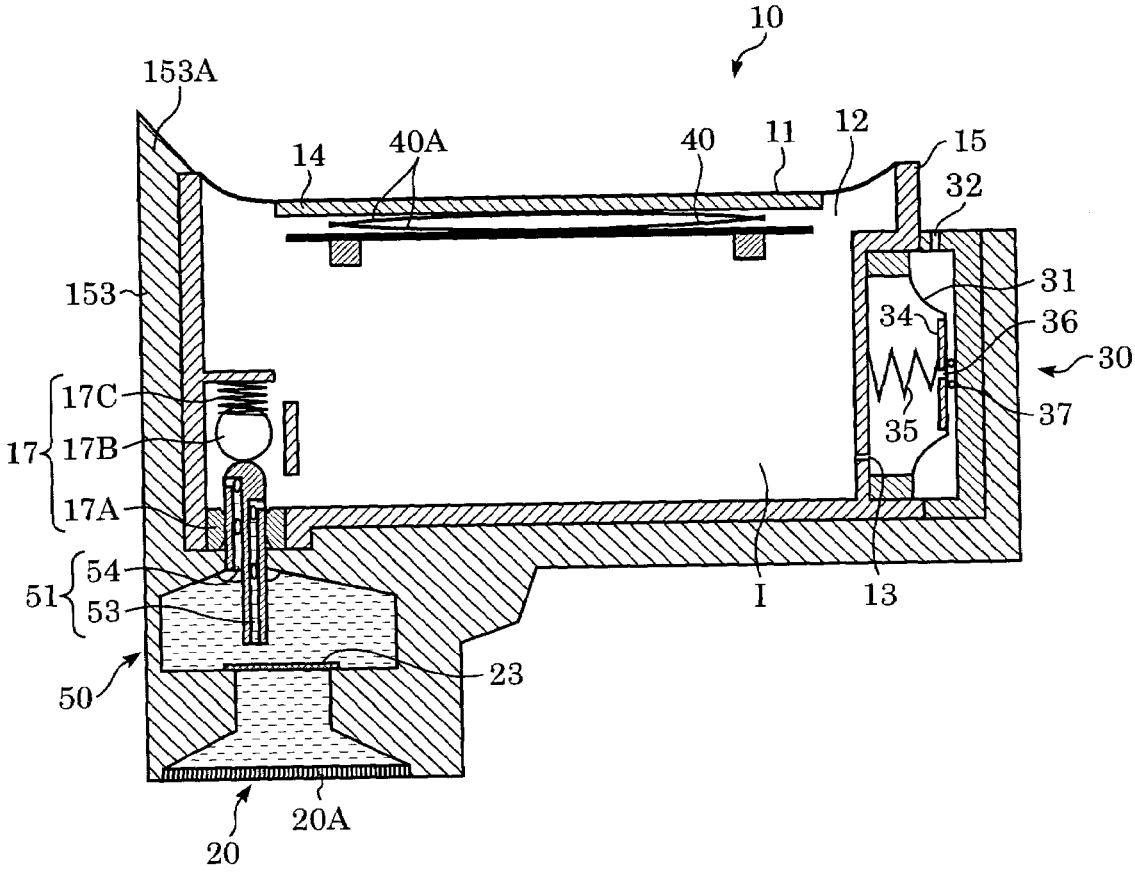
FIG. 14 is a schematic sectional view for explaining a premise of a preferable arrangement applied to the first embodiment.

FIG. 14 shows a state just after the ink in the ink tank 10 has been almost completely consumed. In this state, the ink flow path 53 is filled with ink. However, since the tank side opening position of the air flow path 54 is located at a relatively upper position, the air flow path 54 is in the multi-meniscus state because air is captured thereinto.

When the ink tank 10 is replaced with a new ink tank 10 in this state, first, ink and gas are transferred from the liquid chamber 50 into the ink accommodation chamber 12 through the air flow path 54 as explained in FIGS. 8 and 9. However, since the position of the ink interface in the liquid chamber 50 is located near to the head side opening of the air flow path 54, the ink in the liquid chamber 50 is also captured into the ink flow path 53 when the ink and the gas are transferred before the ink tank 10 has been completely mounted. Accordingly, it is contemplated that the multi-meniscus state in the air flow path 54 is not eliminated even after the pressures in the ink accommodation chamber 12 and the liquid chamber 50 have been averaged through the air flow path 54. That is, it is contemplated that the air transfer stops in the state shown in FIG. 5.

To avoid the above state, replacement with the new ink tank should be executed after the state shown in FIG. 7 is obtained by further consuming ink in place of executing the replacement in the state shown in FIG. 14. With this operation, it can be said that ink can be used more unwastefully because the ink tank 10 is replaced after the ink in it has been completely consumed.

The inkjet recording apparatus and the ink tank are often provided with an ink remaining amount sensor which is used to detect whether ink remains and to prompt replacement of the ink tank 10. To replace the ink tank 10 after the state shown in FIG. 7 is obtained, the ink remaining amount sensor is disposed at an appropriate portion of, for example, the liquid chamber.

Further, there may be a case that the ink tank 10 is mounted without obtaining the state shown in FIG. 9, that is, without sufficiently eliminating the multi-meniscus state in the air flow path 54 because a user executes an ink tank mounting operation promptly. In this case, the multi-meniscus state in the air flow path 54 can be sufficiently eliminated by reducing an ink tank mounting speed by providing a damper mechanism with an ink tank mounting section of the carriage or by providing a mechanism which stops a push operation for mounting the ink tank once in the state of FIG. 9 and is locked to a final mounting position when the push operation is further executed.

(Example of Arrangement of Inkjet Recording Apparatus)

Figure 15:
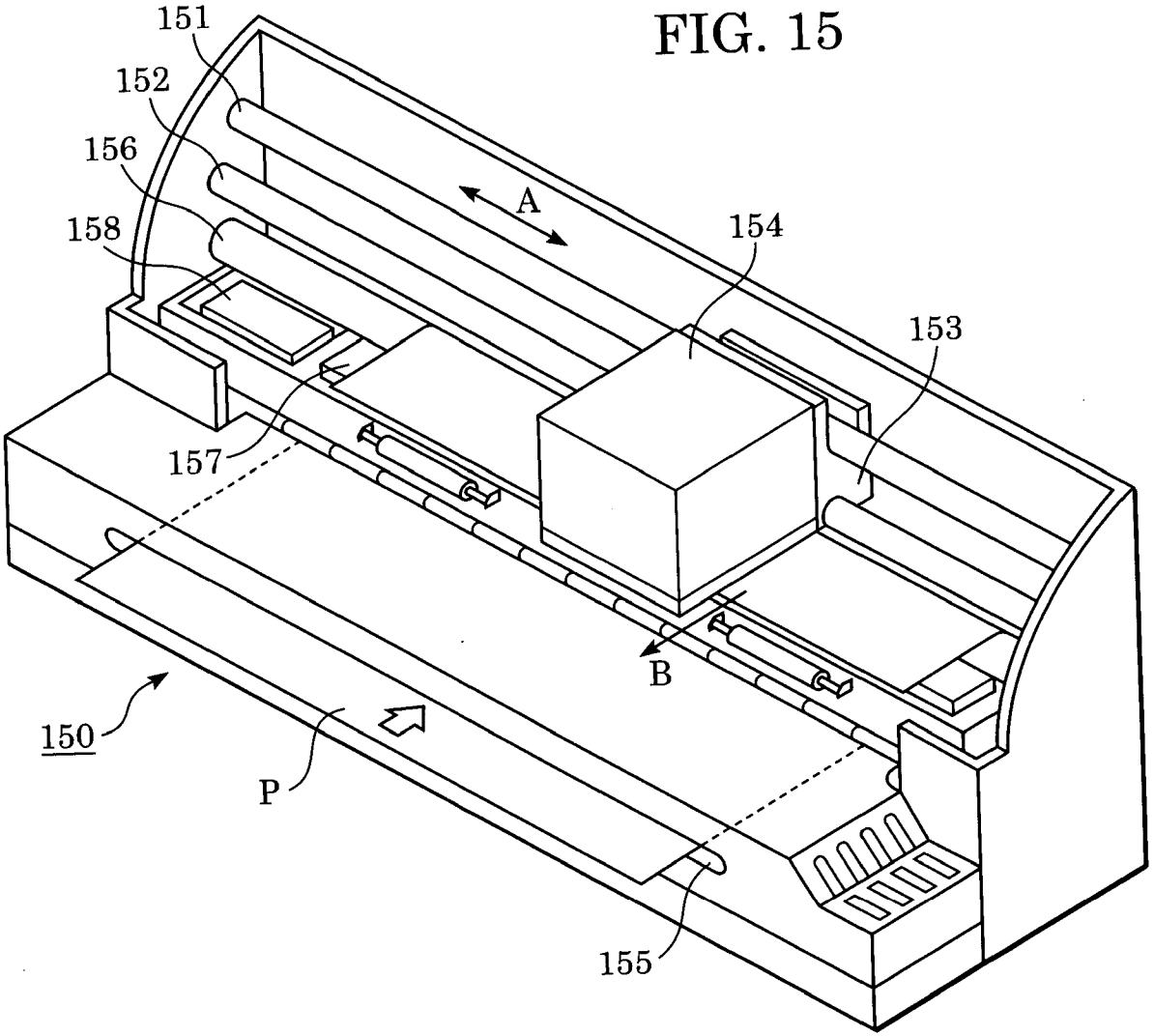
FIG. 15 is a perspective view showing an example of the arrangement of an inkjet recording apparatus to which the present invention can be applied.
Figure 16:
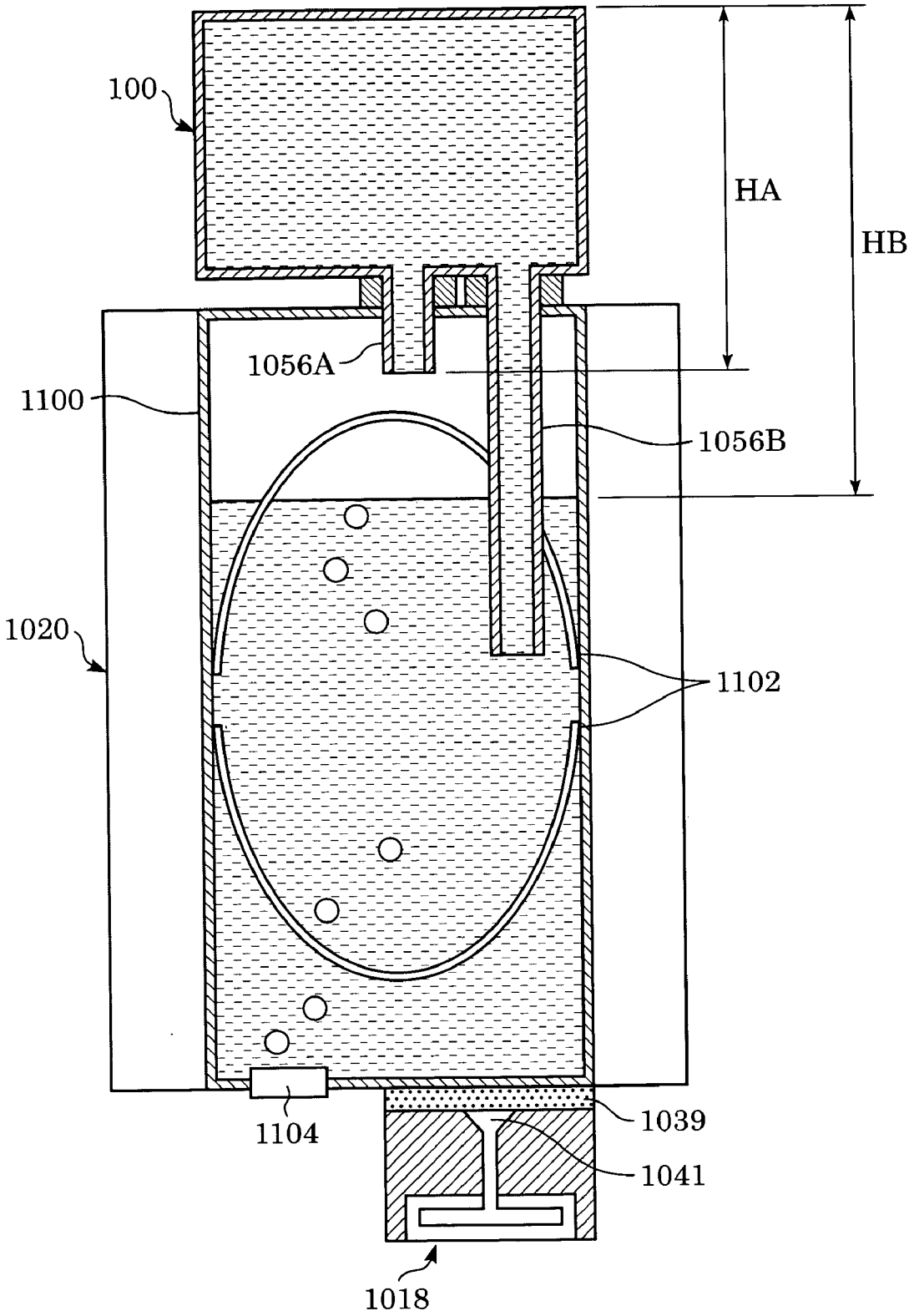
FIG. 16 PRIOR ART
FIG. 16 is a sectional view explaining a conventional example of an ink supply system.

FIG. 15 is a view explaining an example of the arrangement of an inkjet recording apparatus 150 to which the present invention can be applied.

The inkjet recording apparatus 150 of the example is a serial scan type inkjet recording apparatus. In the inkjet recording apparatus 150, a carriage 153 is guided by guide shafts 151, 152 so as to move in a main scanning direction shown by an arrow A. The carriage 153 is reciprocated in the main scanning direction by a drive force transmission mechanism composed of a carriage motor, a belt for transmitting the drive force of the carriage motor, and the like. The carriage 153 has a liquid supply system 154 mounted thereon. The liquid supply system 154 is composed of an assembly of a recording head and a liquid chamber and an ink tank mounted on the assembly, the liquid supply system 154 making it possible to execute the above embodiment. A sheet P as a recording medium is inserted from an insertion port 155 disposed to an front end of the apparatus and then transported in a subscan direction shown by an arrow B by a feed roller 156 after its transporting direction is inverted. The recording apparatus sequentially records an image on the sheet P by repeating a recording operation and a transporting operation. In the recording operation, ink is ejected onto a recording region of the sheet P on a platen 157 while moving the recording head in the main scan direction. In the transporting operation, the sheet P is transported in the subscan direction by a distance corresponding to a recording width of the sheet P.

Note that, as described above, the recording head may utilize thermal energy generated from an electrothermal transducer as energy for ejecting ink. In this case, ink is film-boiled by the heat generated by the electrothermal transducer, and ink can be ejected from ink ejection ports by foaming energy at the time. Further, an ink ejection system in the recording head is not limited to the system using the electrothermal transducer as described above, and a system for ejecting ink using, for example, a piezo element, and the like may be employed.

In FIG. 15, a recovery system unit (recovery processing means) 158 is disposed at a left end of the carriage 153 in the moving region thereof in confrontation with an ink ejection port forming surface of the recording head. The recovery system unit 158 includes a cap capable of capping the ink ejection ports of the recording head and a suction pump capable of introducing a negative pressure into the cap. The recovery system unit 158 can execute recovery processing by sucking and discharging ink from the ink ejection ports by introducing the negative pressure into the cap that covers the ink ejection ports. As a result, the recording head can be maintained in a good ink ejection state. Further, the recovery system unit 158 can also execute recovery processing (also called "preliminary ejection processing") by ejecting ink from the ink ejection ports into the cap different from image formation so that the recording head is maintained in the good ejection state. These processings can be also executed to satisfy the condition of the expression (4) described above when a new ink tank is mounted.

(Others)

As described above, according to the above embodiment, the two flow paths are formed by dividing the interior of the connecting section 51 into the two portions, and the head side openings of the respective flow paths are disposed at the positions having a different height. Accordingly, the gas built up in the region upstream of the filter can be promptly transferred to the ink tank side without the need for a complex arrangement. The flow path whose head side opening is located at the lower position in the vertical direction has the tank side opening located also at the lower position in the vertical direction. Further, the flow path whose head side opening is located at the upper position in the vertical direction has the tank side opening located also at the upper position in the vertical direction. With the above arrangement, even if the multi-meniscus state occurs in the interiors of the flow paths, it can be eliminated by inserting a new tank, thereby remaining gas can be more smoothly transferred.

Further, when a small amount of ink is ejected or sucked from the ejection port forming surface after an ink tank replacing operation is executed, the gas built up in the supply section can be promptly and smoothly transferred to the ink tank side and discharged from the supply path. With this operation, a large amount of ink is not wasted as in a case that gas is discharged by a sucking operation executed from the ejection port side.

Note that, when the negative pressure in the ink accommodation chamber exceeds a predetermined value in a process for supplying ink from the ink tank, gas is captured from the outside into the ink accommodation chamber by the action of the valve chamber as described above.

The present invention is by no means limited to the above embodiment and can be variously modified as long as the modifications eliminate the multi-meniscus state by causing the air flow path to communicate with the liquid chamber and the ink tank prior to the ink flow path.

In the above embodiment, the connecting section 51 is arranged, for example, integrally with the liquid chamber 50. However, the present invention is not limited thereto and the connecting section 51 can be disposed to the ink tank 10 side, and the same effect can be obtained with this arrangement. In this case, for example, a cylindrical seal member is disposed to the liquid chamber 50 along a receiving portion of the ink flow path 53 so that the liquid chamber side opening of the ink flow path 53 passes through the cylindrical seal member and communicates with the liquid chamber after the liquid chamber side opening of the air flow path 54 communicates with the liquid chamber.

Although the two flow paths are formed in the single connecting section 51 in the above embodiment, two connecting sections each having a single flow path formed therein may be used. In this case, one of the connecting sections (for example, a connecting section for the ink flow path) may be disposed to the ink tank 10 side, and the other connecting section (for example, a connecting section for the air flow path) may be disposed to the liquid chamber 50 side. Since the same operation and effect can be obtained with the above arrangement, it is also within the scope of the present invention.

The number of the flow paths is not limited to two, and three or more flow paths may be provided. When the connecting section includes a plurality of flow paths formed by dividing the interior thereof into a plurality of portions, the connecting section may be arranged in a multi-tube structure having a plurality of concentric tubes therein, in addition to that linear partition walls are formed between the flow paths as in the above example.

When the connecting section includes the plurality of flow paths formed by dividing the interior thereof into the plurality of portions, the respective flow paths need not be perfectly partitioned from each other unless a smooth and prompt gas/liquid exchange is inhibited by the interference between transfer of gas and movement of ink.

In the above arrangement, the valve chamber 30, which introduces outside air into the ink tank 10, is arranged integrally with the ink tank 10. However, when outside air can be directly introduced into the ink tank 10 without passing through the valve chamber 30, the valve chamber need not be necessarily arranged integrally with the ink tank. For example, the valve chamber may be disposed to the carriage 153 side so that it directly communicates with the ink tank through the interiors thereof when the ink tank is mounted.

Any of the respective embodiments of the ink supply system described above basically employs such an arrangement that ink is basically reserved or supplied as it is without being held in an absorbent and the like. In contrast, the negative pressure generation means is composed of the movable members (the sheet member and the pressure plate) and the spring members for urging them as well as the interior of the ink supply system is hermetically sealed so that an appropriate negative pressure acts on the recording head.

The above arrangement has a volume efficiency higher than a conventional arrangement, which generates a negative pressure by an absorbent, and can improve a degree of freedom when ink is selected. In addition to the above, the arrangement can preferably meet a request for increasing a flow rate of ink to be supplied and for supplying ink stably, the request being made to cope with a recent increase in recording speed.

As for eliminating gas built up in the supply path, the gas is transferred to the ink tank located at the uppermost upstream position farthest from the recording head. For this purpose, the ink tank is caused to communicate with the ink supply path through the plurality of flow paths as well as ink is derived from the ink tank and gas is introduced into the ink tank concurrently making use of the pressure balance between the ink tank and the ink supply path.

According to the above arrangement, the gas built up in the supply path can be smoothly and promptly discharged to the ink tank side by a simple structure without the need of a complex apparatus and without an increase in the number of parts. Further, since the gas is discharged making use of the pressure balance, high reliability can be obtained in the discharge of gas.

Since the ink tank is maintained in the negative pressure at all times in the gas discharge process, a liquid can be securely prevented from leaking from the ink ejection ports of the inkjet recording head, and the like. Further, since gas is discharged from the ink tank side, an amount of consumption of ink can be much more reduced than a method of discharging gas by sucking ink from the ejection ports of the recording head, which can also contribute to the reduction of running cost by suppressing wasteful consumption of ink.

In addition to the above, when the ink tank, which can be detachably mounted on the supply path, is used, the ink tank is conventionally replaced in many cases in a state that the ink supply path is filled with ink, that is, before ink is perfectly consumed to prevent gas from entering the ink supply path side when the ink tank is replaced. According to the above arrangement, however, even if gas enters the liquid chamber before the ink tank is replaced or while it is being replaced with a new ink tank, the gas can be easily and promptly discharged into the new ink tank when it is mounted. As a result, the ink tank can be replaced with the new ink tank after the ink in the ink tank has been completely consumed. This arrangement not only further reduces running cost but also greatly contributes to the solution of environmental problems. In any of the above arrangements, the ink tank is disposed at a highest position in its attitude used ordinarily and the assembly of the liquid chamber and the recording head is disposed at a low position. This layout is very preferable to execute the gas/liquid exchange promptly and smoothly by a single arrangement.

When ink contains a pigment as a color material, air disperses settling of pigment particles when it is transferred into the ink tank, thereby ink can be stably reserved and ejected reliably.

In addition to the above-mentioned, since ink can be supplied while keeping the negative pressure in the head stably, a recording performance, reliability and cost reduction can be simultaneously realized.

Note that the gas introduced into the ink tank may be reserved at any portion in the ink tank unless it returns to the ink supply path and inhibits an ink supply, although this depends on an arrangement of the ink tank. However, the arrangement of the above embodiment, in which ink is reserved as it is without being absorbed by the absorbent and the like, is preferable because the introduced gas is located in an uppermost portion of the ink tank as it is.

When no absorbent exists in the ink tank as in the arrangement described above, the volume of the ink tank itself can be utilized as the volume of ink, it is not necessary to make a size of the ink tank larger than necessary, and further a shape of the tank can be designed relatively freely.

A basic condition for constituting the present invention resides in that the liquid chamber has the hermetically-sealed structure for permitting ink to be reserved therein as it is except the portion connected to the ink tank and the portion connected to the recording head and that outside air is directly introduced into the ink tank to maintain a preferable negative pressure to thereby minimize the gas entering the liquid chamber that directly communicates with the recording head. This condition is very preferable to increase a flow amount of ink to be supplied, to stably supply ink, and to preferably maintain an ejection characteristic even if recording (ejection) is executed at high speed, which is neither disclosed nor suggested in any of the patent documents 1 to 5.

As long as the basic condition is satisfied, the negative pressure generation means may also employ an arrangement other the combination of the spring and the flexible member as in the above respective embodiments. That is, the basic condition of the present invention does not exclude the employment of an absorbent as the negative pressure generation means.

The serial type inkjet recording apparatus is applied in the above explanation as the recording system of the embodiments. However, the present invention and the embodiments are by no means limited to the serial type inkjet recording apparatus. Further, the present invention and the embodiments can be applied even to a line scan type (not the serial type) recording apparatus. Furthermore, it is needless to say that a plurality of liquid supply systems can be provided in correspondence to the color tones (colors, densities, and the like) of ink.

Although the case that the present invention is applied to the ink tank for supplying ink to the recording head has been described above, the present invention may be applied to a supply section that supplies ink to a pen acting as a recording section.

Further, the present invention can be applied to a wide range such as an apparatus that supplies various liquids including drinking water, liquid seasonings, and the like and to a medical field in which medicines are supplied, in addition to the various types of the recording apparatuses described above.

While the present invention has been described with reference to what are presently considered to be the embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid supply system comprising:

a liquid accommodating section having a liquid storage adapted to store liquid, the liquid accomodating section including means for generating a negative pressure with respect to an atmospheric pressure within the liquid storage;

a liquid-using section;

a liquid chamber in communication with the liquid-using section;

a plurality of communication paths, including first and second communication paths, that facilitates communication between the liquid chamber and the liquid accommodating section;

the liquid chamber includes a substantially hermetically sealed space except where the space communicates with the plurality of communication paths and with the liquid-using section; and each of the first and second communication paths includes a liquid chamber side opening extending into the liquid chamber and a liquid accommodating section side opening extending into the liquid accommodating section, wherein the liquid chamber side opening of the first communication path extends substantially further into the liquid chamber than the liquid chamber side opening of the second communication path, and the liquid accommodating section side opening of the second communication path extends substantially further into the liquid accommodating section than the liquid accommodating section side opening of the first communication path.

2. A liquid supply system according to claim 1, wherein the plurality of communication paths are attached to the liquid chamber, and wherein the liquid accommodating section can be removably attached to the plurality of communication paths.

3. A liquid supply system according to claim 2, wherein the liquid accommodating section comprises:

means for placing the liquid-using section in a negative pressure state with respect to an atmospheric pressure; and means for directly introducing outside air into the liquid accommodating section without passing through the liquid chamber so as to regulate the negative pressure state.

4. A liquid supply system according to claim 1, wherein the liquid accommodating section comprises:

means for placing the liquid-using section in a negative pressure state with respect to an atmospheric pressure; and means for directly introducing outside air into the liquid accommodating section without passing through the liquid chamber so as to regulate the negative pressure state.

5. A fluid communication structure that facilitates communication between a liquid accommodating section accommodating a liquid and a liquid use section using the liquid, comprising:

a liquid chamber communicating with the liquid use section; and a plurality of communication paths facilitating communication between the liquid chamber and the liquid accommodating section, the plurality of communication paths capable configured to connect with the liquid accommodating section;

the liquid chamber includes a substantially hermetically sealed space except where the space communicates with the plurality of communication paths and with the liquid use section; and the plurality of communication paths includes at least first and second communication paths each having a liquid chamber side opening extending into the liquid chamber and a liquid accommodating section side opening extending into the liquid accommodating section, wherein the liquid chamber side opening of the first communication path extends substantially further into the liquid chamber than the liquid chamber side opening of the second communication path, and the liquid accommodating section side opening of the second communication path extends substantially further into the liquid accommodating section than the liquid accommodating section side opening of the first communication path, wherein gas existing in the hermetically sealed space can be transferred to the liquid accommodating section through the second communication path.

6. A fluid communication structure according to claim 5, wherein the fluid communication structure is located substantially below the liquid accommodating section and located substantially above the liquid use section with respect to a vertical direction.

7. A fluid communication structure according to claim 6, wherein an operation in which the gas existing in the hermetically sealed space moves into the liquid accommodating section and the liquid in the liquid accommodating section is transferred to the liquid use section is executed according to a pressure difference due to a water head of the liquid corresponding to a difference of heights of the liquid chamber side openings of the plurality of communication paths in the vertical direction and a pressure difference due to meniscuses formed in the plurality of communication paths by the liquid.

8. An inkjet recording head for executing recording by ejecting ink, comprising the fluid communication structure according to claim 6, wherein the fluid communication structure being arranged integrally with the recording head.

9. An inkjet recording head for executing recording by ejecting ink, comprising the fluid communication structure according to claim 7, wherein the fluid communication structure being arranged integrally with the recording head.

10. An inkjet recording head for executing recording by ejecting ink, comprising the fluid communication structure according to claim 5, wherein the fluid communication structure being arranged integrally with the recording head.

11. An ink supply system comprising:

an ink tank that having an ink storage adapted to store ink, the ink tank including means for generating a negative pressure with respect to an atmospheric pressure within the ink storage;

a recording head ejecting ink;

a liquid chamber in communication with the recording head;

a plurality of communication paths, including first and second communication paths, that facilitates communication between the liquid chamber and the ink tank;

the liquid chamber includes a substantially hermetically sealed space except where the space communicates with the plurality of communication paths and with the recording head; and each of the first and second plurality of communication paths includes a liquid chamber side opening extending into the liquid chamber and an ink tank side opening extending into the ink tank, wherein the liquid chamber side opening of the first communication path extends substantially further into the liquid chamber than the liquid chamber side opening of the second communication path, and the ink tank side opening of the second communication path extends substantially further into the ink tank than the ink tank side opening of the first communication path.

12. An ink supply system according to claim 11, wherein the plurality of communication paths are attached to the liquid chamber, and wherein the ink tank can be removably attached to the plurality of communication paths.

13. An inkjet recording apparatus incorporating the ink supply system according to claim 12, wherein the liquid chamber is located substantially above the recording head and the ink tank is located substantially above the liquid chamber with respect to a vertical direction.

14. An ink supply system according to claim 11, wherein the ink tank comprises:

means for placing the recording head in a negative pressure state with respect to an atmospheric pressure; and means for directly introducing outside air into the ink tank without passing through the liquid chamber so as to regulate the negative pressure state.

15. An inkjet recording apparatus incorporating the ink supply system according to claim 14, wherein the liquid chamber is located substantially above the recording head and the ink tank is located substantially above the liquid chamber with respect to a vertical direction.

16. An inkjet recording apparatus incorporating the ink supply system according to claim 11, wherein the liquid chamber is located substantially above the recording head and the ink tank is located substantially above the liquid chamber with respect to a vertical direction.

* * * * *